US006484137B1

(12) United States Patent
Taniguchi et al.

(10) Patent No.: US 6,484,137 B1
(45) Date of Patent: Nov. 19, 2002

(54) AUDIO REPRODUCING APPARATUS

(75) Inventors: Hirotsugu Taniguchi, Neyagawa; Masayuki Misaki, Kobe; Junichi Tagawa, Hirakata; Michio Matsumoto, Sennan, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/181,992

(22) Filed: Oct. 29, 1998

(30) Foreign Application Priority Data

Oct. 31, 1997 (JP) ..... 9-300121
Aug. 3, 1998 (JP) ..... 10-218925

(51) Int. Cl.[7] ..... G10L 21/04

(52) U.S. Cl. ..... 704/211; 704/267; 704/278; 704/504

(58) Field of Search ..... 704/503, 278, 704/267, 211, 504; 386/104, 101

(56) References Cited

U.S. PATENT DOCUMENTS

| | | | | |
|---|---|---|---|---|
| 5,479,564 A | * | 12/1995 | Vogten et al. | 704/267 |
| 5,583,652 A | * | 12/1996 | Ware | 386/75 |
| 5,611,002 A | * | 3/1997 | Vogten et al. | 704/267 |
| 5,630,013 A | * | 5/1997 | Suzuki et al. | 704/216 |
| 5,809,454 A | * | 9/1998 | Okada et al. | 704/214 |
| 5,828,994 A | * | 10/1998 | Covell et al. | 704/211 |
| 6,009,386 A | * | 12/1999 | Cruickshank et al. | 704/207 |
| 6,370,315 B1 | * | 4/2002 | Mizuno | 386/46 |

FOREIGN PATENT DOCUMENTS

| | | |
|---|---|---|
| JP | 4-104200 | 4/1992 |
| JP | 9-73299 | 3/1997 |
| JP | 9-81189 | 3/1997 |

OTHER PUBLICATIONS

Suzuki, R. and M. Misaki, "Time–Scale Modification of Speech Signals Using Cross–Correlation," IEEE 1992 Int. Conf. on Consumer Electronins. 1992 ICCE, Jun. 2–4, 1992, pp. 357–363.*

"Institute of Electronics, Information and Communication Engineers (SP90–34, 1990.8)" by Suzuki and Misaki.

"A Study of Speech/Noise discrimination Method Using Fuzzy Reasoning" by Nakatoh et al. (Electronic Information Communication A–233 1993).

"Characteristics of Duration of Phonetic Classification of Continuous Speech" by Hiki et al.

"Enhancing Speech Perception of Japanese Learners of English Utilizing Time–Scale Modification of Speech and Related Techniques" by K. Nakayama, K. Tomita–Nakayama, M. Misaki Speech Technology in Language Learning. KTH, 123–126.

"Examination of Hearing Ability to 67–S High–Speed Word for Auxiliary Hearing Effects", by Hosoi et al. Audiology Japan vol. 36 No. 5 pp. 299–300 (1993).

* cited by examiner

*Primary Examiner*—Marsha D. Banks-Harold
*Assistant Examiner*—Donald L. Storm
(74) *Attorney, Agent, or Firm*—Wenderoth, Lind & Ponack, L.L.P.

(57) ABSTRACT

An audio reproducing apparatus comprises: audio decoding means for decoding an input audio signal frame by frame; data expanding/compressing means for subjecting data in a decoded frame to time-scale modification process; a frame sequence table which contains a sequence determined according to a given speed rate in which respective frames are expanded/compressed; frame counting means for counting the number of frames of the input audio signal; and data expansion/compression control means for instructing the dalta expanding/compressing means to subject the frame to one of time-scale compression process, time-scale expansion process, and process without time-scale modification process, with reference to the frame sequence table based on a count value output from the frame counting means, the data expanding/compressing means subjecting the audio signal to time-scale modification process in accordance with an instruction signal from the data expansion/compression control means.

58 Claims, 22 Drawing Sheets normal frame compressed frame expanded frame time
first frame
second frame
third frame
Fig.4 (a) speed rate : 1.5
Fig.4 (b) speed rate : 1.2
Fig.4 (c) speed rate : 1.1
Fig.4 (d) speed rate : 0.9
Fig.4 (e) speed rate : 0.8
Fig.4 (f) speed rate : 0.7
a : through b : compression c : expansion one frame = two segments Fig.6 (a) original frame
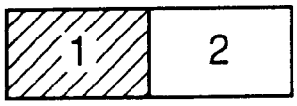
Fig.6 (b) reference form
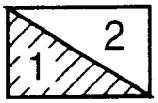
Fig.6 (c) shift in positive direction
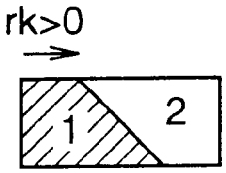
Fig.6 (d) shift in negative direction
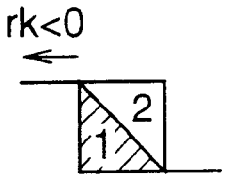

reference form
previously compressed frame
1'
2'
shift of pointer
1
2
P1
P2
current reference form
1
2 shift in positive direction
rk>0
1'
2'
rk
1
2
P1
P2
1
2 shift in negative direction
rk<0
1'
2'
rk
1
2
P1
P2
1
2

Fig.24 (a)
first half signal
Fig.24 (b)
second half signal
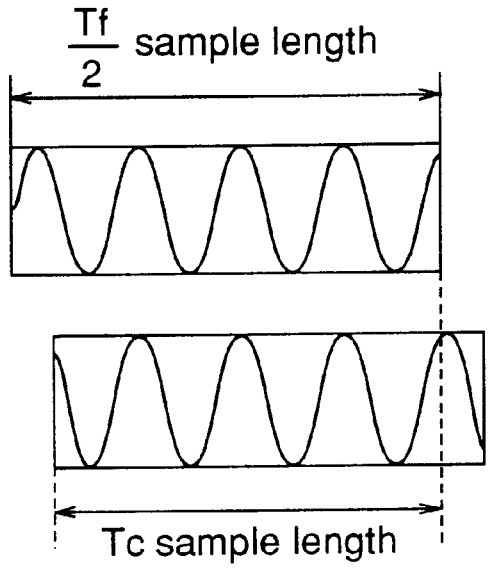
Fig.25 (a)
fading out
Fig.25 (b)
fading in
Fig.25 (c)
cross fading
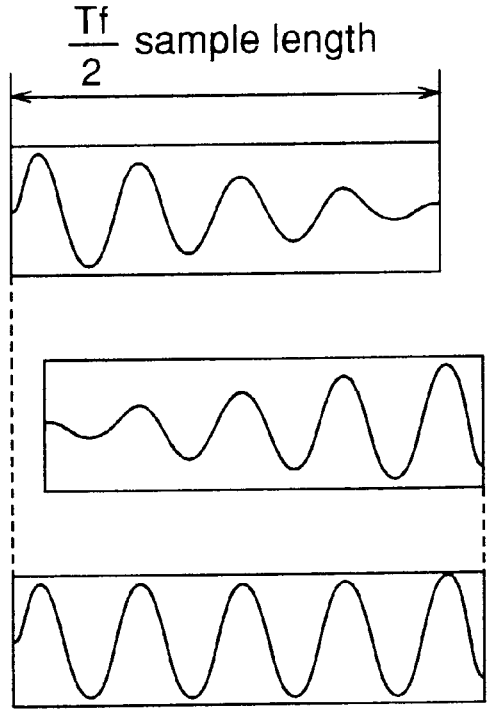

AUDIO REPRODUCING APPARATUS

FIELD OF THE INVENTION

The present invention relates to an audio reproducing apparatus which is capable of converting a value of an audio playback speed into a desired value and obtaining the resulting audio.

BACKGROUND OF THE INVENTION

In recent years, techniques for coding audio data with high efficiency, storing coded audio data in a storage medium, or transmitting the coded audio data over communication networks, have been put into practical use and widely utilized.

As for such techniques, apparatus for reproducing audio according to MPEG (Moving Picture Experts Group) as an international standard is disclosed in Japanese Published Patent Application No. Hei. 9-73299. FIG. 19 is a block diagram showing this MPEG audio reproducing apparatus Hereinafter, a description is given of a prior art audio reproducing apparatus with reference to FIG. 19.

Referring now to FIG. 19, an MPEG audio reproducing apparatus 1 comprises a reproducing speed detecting circuit 2, an MPEG audio decoder 3, a time-scale modification circuit 4, a D/A converter 5, and an audio amplifier 6. The time-scale modification circuit 4 comprises a frame memory 34, a time-scale modification unit 35, a ring memory 32, an up down counter 33, and a read clock generating circuit 36.

An MPEG audio stream which has been coded by the MPEG audio method is input to the MPEG audio reproducing apparatus 1. The MPEG audio decoder 3 decodes the MPEG audio stream into an audio output of a digital signal. The MPEG audio method and formats are described in various kinds of references, including "ISO/IEC IS 11172 Part 3: Audio".

Meanwhile, speed information such as double speed and 0.5 multiple speed is input to the reproducing speed detecting circuit 2, which detects the speed information (reproducing speed) and generates a decoding clock. The decoding clock is supplied to the time-scale modification circuit 4 and the MPEG audio decoder 3. An audio signal which has been decoded by the MPEG audio decoder 3 is input to the circuit 4, where it is subjected to time-scale compression/expansion or unvoiced sound deletion/insertion based on the given speed information, whereby time-scale modification process is performed, and the resulting output is reproduced through a speaker 23.

However, in the MPEG audio coding method which performs decoding frame by frame of a prescribed time length, data processing of plural frames requires numerous buffer memories and increases complexity, which causes a large-scale hardware structure.

Another apparatus for reproducing audio according to the MPEG is disclosed in Japanese Published Patent Application No. Hei 9-81189. FIG. 20 is a block diagram showing this MPEG audio reproducing apparatus. Hereinafter, a description is given of another prior art audio reproducing apparatus with reference to FIG. 20.

Referring to FIG. 20, reference numeral 1701 designates a first frame diving unit for dividing an input subband signal 1 and holding a signal of one frame of a Tf sample length, reference numeral 1702 designates a second frame diving unit for dividing an input subband signal 2 and holding a signal of one frame of a Tf sample length, reference numeral 1703 designates a third frame diving unit for dividing an input subband signal 3 and holding a signal of one frame of a Tf sample length, and reference numeral 1704 designates a fourth frame diving unit for dividing an input subband signal 4 and holding a signal of one frame of a Tf sample length.

The input subband signals 1–4 are subband signals of four subbands divided by a filter bank which divides a normal time-scale signal into four subband signals by ¼ downsampling. Assume that the subband signal 1 is the lowest subband signal and the subband signal 4 is the highest subband signal.

Reference numeral 1710 designates a correlation function calculating unit which calculates correlation values S(n) in an overlapping portion of n samples of first half and second half signals of a subband signal of a subband containing audio pitch components, and which detects a maximum value n of the correlation values S(n) as "Tc". Reference numeral 1711 designates a reproducing speed detecting unit which detects specification of a reproducing speed F by an auditor. Reference numeral 1712 designates a correlation function detection range control unit which limits a correlation function detection range. Reference numeral 1705 designates a first cross fading unit which performs cross fading process to overlapped Tc samples of the first half and second half signals of the subband signal divided and held by the first frame dividing unit 1701. Reference numeral 1706 designates a second cross fading unit which performs cross fading process to overlapped Tc samples of the first half and second half signals of the subband signal divided and held by the second frame dividing unit 1702. Reference numeral 1707 designates a third cross fading unit which performs cross fading process to overlapped Tc samples of the first half and second half signals of the subband signal divided and held by the third frame dividing unit 1703. Reference numeral 1708 designates a fourth cross fading unit which performs cross fading process to overlapped Tc samples of the first half and second half signals of the subband signal divided and held by the fourth frame dividing unit 1704. Reference numeral 1709 designates a synthesizing filterbank which synthesizes subband signals of four subbands which have been subjected to cross fading process.

FIG. 21 is a diagram showing time-scale waveform of one frame of a frequency band which contains main pitch components of an audio signal.

FIG. 22 is a diagram showing two segments of the first half and second half signals into which one frame signal in FIG. 21 has been divided, as upper and lower segments.

FIG. 23 is a graph showing values of a correlation function between the two segments in FIG. 22.

FIG. 24 is a diagram qualitatively showing a state in which the segment of the second half signal component is shifted to a time when the correlation function takes the maximum value.

FIGS. 25(*a*)–25(*c*) are diagrams showing a case where cross fading process is performed with two segments overlapped for a Tc time period.

Subsequently, a description is given of operation of the reproducing apparatus so constructed with reference to FIGS. 21 through 25(*a*)–25(*c*).

First of all, suppose that data of one frame (Tf sample length) of the input subband signal 1 includes main pitch components of the audio signal as shown in FIG. 21. The one frame data is divided into two segments which are equal in the number of data as shown in FIG. 22 and held by the first frame dividing unit 1701. In a like manner, the subband signals 2, 3, and 4 are respectively divided into two segments and held by the second, third, and fourth frame dividing units 1702, 1703, and 1704, respectively.

Then, from a target speed rate F obtained by the reproducing speed detecting unit 2, a data length of an overlapping portion of the two segments, i.e., a target overlapping value Tb is found according to the following equation:

$$Tb=Tf\cdot(1-1F)$$

Considering a correction parameter B (initialization value=0) for correcting deviation from the target speed rate F due to phase adjustment mentioned later, the correlation function calculating unit 1710 calculates correlation in a range of m samples before and m samples after an overlapping interval data length (Tb+B) of two segments in the first frame dividing apparatus 1701, to find an overlapping interval length Tc where the correlation function takes the maximum value. Then, to correct the error between the target speed rate F and an actual speed rate resulting from difference between Tc and Tb, a value of the correction parameter B is updated as follows:

$$B \leftarrow B+Tb-Tc$$

In FIG. 22, there is shown a case where two upper and lower segments are disposed separately, by setting the target speed rate F to be 2.0 and the target overlapping value to be Tb(=Tf/2). Shown in FIG. 23 is a correlation function of these two segments. As it can be seen from the graph, in the example shown, the correlation function takes the maximum value at time "4". In FIGS. 24(*a*) and 24(*b*), two segments are shown with the overlapping length "Tc", according to the correlation function. More specifically, a degree of similarity between the first half and second half segments is found by the use of the correlation function, and then the second half segment is shifted to the high correlation position, resulting in a match between phases of the two segments. In this case, the overlapping interval length is "Tc".

Subsequently, the first cross fading unit 1705 performs cross fading to the subband signals of two segments divided and held by the first frame dividing unit 1701 with the "Tc" overlapped. In a like manner, the second cross fading unit 1706, the third cross fading unit 1707, and the fourth cross fading unit 1708 perform cross fading to the subband signals of two segments divided and held by the second frame dividing unit 1702, the third frame dividing unit 1703, and the fourth frame dividing unit 1704, respectively, with the "Tc" overlapped. FIGS. 25(*a*)–25(*c*) show an example of this cross fading process. In this cross fading process, to the overlapping portion of two segments, addition is performed by complementary weighting. Shown in FIG. 25(*a*) is a signal in which the first half segment has been subjected to fading-out process. Shown in FIG. 25(*b*) is a signal in which the second half segment has been subjected to fading-in process. The signals in FIG. 25(*a*) and in FIG. 25(*b*) are added, resulting in a waveform shown in FIG. 25(*c*).

Thereafter, the synthesizing filterbank 1709 synthesizes respective subband signals so cross-faded, to produce the normal time-scale signal.

The above process is serially performed to signals of respective subbands for all the frames each comprising Tf samples, thereby performing high-speed reproduction which is completed by processing data in one frame.

However, there have been problems associated with the reproducing apparatus so constructed, which will be described below.

Here, it is assumed that a standard MPEG1 audio coding method is employed, and the number of divided subbands, the number of data of one frame of each subband, an initialization value of the correction parameter B, and a correction search width m as a reference are "32", "36", "0", and "4", respectively. Actual overlapping values and the points of correlation search, are found by the method illustrated in the prior art example. The calculation results are shown, in which decimal points are truncated.

TABLE 1

| | | | | | | |
|---|---|---|---|---|---|---|
| Target speed rate F | 1.1 | 1.3 | 1.5 | 1.7 | 1.9 | 2.0 |
| target overlapping value Tb | 3 | 6 | 12 | 14 | 17 | 18 |
| range of overlapping value | 0–7 | 2–10 | 8–16 | 10–18 | 13–18 | 14–18 |
| points of correlation search | 8 | 9 | 9 | 9 | 6 | 5 |

First, a case where the speed rate is close to "1.0" will be discussed. Since the target overlapping value is small, the overlapping value is in the small range. In this case, the problem is that the cross fading length is too small. Although high correlation is found and cross fading process is carried out, and if the transition period in two segments including the cross fading interval is too short, cross fading has little effects on improvement of continuity , so that waveform of a low-frequency signal in the segments rapidly changes. As a result of this, reproduced audio with discontinuity is obtained. Evaluation experiments on the cross fading interval length, the correlation retrieval width, and audio quality is, for example, described in "Institute of Electronics, Information and Communication Engineers (SP90-34, 1990.8)" by Suzuki and Misaki, which illustrates an optimum value for PCM (pulse coded modulation) audio.

Next, a case where the speed rate is close to "2.0" will be discussed. As can be seen from the table 1, the target overlapping value is approximately 18, i.e., an upper limit, the upper limit of the overlapping value does not exceed one segment length, and the points of correlation search indicates satisfactory number. In case of the speed rate "2.0", if the overlapping value takes a value smaller than the target value "18", since there is no possibility that this will be corrected later, a fixed overlapping value must be taken without correlation search in order to achieve the target speed. In addition, if the search width m takes a larger value so as to increase the points of correlation search, the correction parameter B takes a positive value when an overlapping value is smaller than the target overlapping value, and therefore an overlapping value (Tb+B) of subsequent correlation search exceeds one segment length ((Tb+B)>Tf/2), which makes it difficult to correct the speed rate. For this reason, it is required that the search width m take a smaller value, and correspondingly the points of correlation retrieval becomes fewer. Therefore, cross fading process is performed without satisfactorily improved phase matching. As a result, a hoarse voice due to phase mismatching is obtained.

Thus, use of this algorithm leads to operation under unsatisfactory conditions for phase adjustment according to the correlation function, in which case, high performance is not obtained.

Further, even in a range in which approximately 1.5 speed rates fall, since all the given frames are subjected to cross fading process, distortion due to processing occurs in all the frames, so that considerable degradation is felt by auditors.

From the foregoing description, one disadvantage of the illustrated example is that a method for improving phase matching according to the correlation function does not work satisfactorily and has difficulty in converging into the target speed rate.

Another disadvantage of the illustrated example is that it provides high-speed reproduction, but does not provide low-speed reproducing function.

SUMMARY OF THE INVENTION

It is an object of the present invention to provide an audio reproducing apparatus which realizes time-scale modified audio with high/low speed and of high quality, with a simple construction based on time-scale compression/expansion at a prescribed speed rate which is completed by processing data in frames.

Other objects and advantages of the invention will become apparent from the detailed description that follows. The detailed description and specific embodiments described are provided only for illustration since various additions and modifications within the spirit and scope of the invention will be apparent to those skill in the art from the detailed description.

According to a first aspect of the present invention, an audio reproducing apparatus comprises audio decoding means for decoding an input audio signal frame by frame; data expanding/compressing means for subjecting data in a decoded frame to time-scale modification process; a frame sequence table which contains a sequence determined according to a given speed rate in which respective frames are to be expanded/compressed; frame counting means for counting the number of frames of the input audio signal; and data expansion/compression control means for instructing the data expanding/compressing means to subject the frame to one of time-scale compression process, time-scale expansion process, and process without time-scale modification process, with reference to the frame sequence table based on a count value output from the frame counting means, the data expanding/compressing means subjecting the audio signal to time-scale modification process in accordance with an instruction signal from the data expansion/compression control means. Therefore, it is possible to provide an audio reproducing apparatus which realizes time-scale modification process of high quality at a desired speed rate (reproducing rate), with a simple construction in which time-scale compression/expansion process at a fixed speed rate which is completed by processing data in frames is performed.

According to a second embodiment of the present invention, in the audio reproducing apparatus of the first aspect, the data expanding/compressing means includes cross fading means for dividing each frame of the input audio signal into at least two segments and performing weighting addition to waveform data of each segment. Therefore, it is possible to provide an audio reproducing apparatus which realizes time-scale modification process of high quality at a desired speed rate (reproducing rate), with a simple construction in which time-scale compression/expansion process at a fixed speed rate which is completed by processing data in frames is performed.

According to a third aspect of the present invention, in the audio reproducing apparatus of the first aspect, the data expanding/compressing means subjects a frame to time-scale compression/expansion process in a prescribed ratio, and the data expansion/compression control means controls frequency at which frames to be subjected to time-scale compression/expansion process and frames to be output without time-scale modification process appear, to reproduce audio at the given speed rate. Therefore, it is possible to provide an audio reproducing apparatus which realizes time-scale modification process of high quality at a desired speed rate (reproducing rate), with a simple construction in which time-scale compression/expansion process at a fixed speed rate which is completed by processing data in frames is performed.

According to a fourth aspect of the present invention, in the audio reproducing apparatus of the third aspect, the data expanding/compressing means subjects the frame to time-scale compression/expansion process in a prescribed ratio, and the frame sequence table contains the sequence in which frames to be subjected to time-scale compression/expansion process in the frame cycle in which a time-scale compression/expansion sequence is repeated are disposed as uniformly as possible, to reproduce audio at the given speed rate. Therefore, it is possible to provide an audio reproducing apparatus which realizes time-scale modification process of high quality at a desired speed rate (reproducing rate), with a simple construction in which time-scale compression/expansion process at a fixed speed rate which is completed by processing data in frames is performed.

According to a fifth aspect of the present invention, an audio reproducing apparatus comprises audio decoding means for decoding an input audio signal frame by frame; data expanding/compressing means for subjecting data in a decoded frame to time-scale modification process; expansion/compression frequency control means for setting a frame cycle number and the number of frames to be expanded/compressed in the frame cycle according to a given speed rate; energy calculating means for calculating energies of audio signals in respective frames; frame selecting means for selecting frames to be expanded/compressed according to an output of the energy calculating means and an output of the expansion/compression frequency control means; and data expansion/compression control means for instructing the data expanding/compressing means to subject the frame to one of time-scale compression process, time-scale expansion process, and process without time-scale modification process, the frame selecting means selecting low-energy frames with priority. Since distortion resulting from performing time-scale compression/expansion process to low-energy frames is hardly detected, time-scale modified audio of high quality is obtained.

According to a sixth aspect of the present invention, an audio reproducing apparatus comprises audio decoding means for decoding an input audio signal frame by frame; data expanding/compressing means for subjecting data in a decoded frame to time-scale modification process; expansion/compression frequency control means for setting a frame cycle number and the number of frames to be expanded/compressed in the frame cycle according to a given speed rate; means for calculating probabilities that respective frames contain humane voice; frame selecting means for selecting frames to be expanded/compressed according to an output of the calculating means and an output of the expansion/compression frequency control means; and data expansion/compression control means for instructing the data expanding/compressing means to subject the frame to one of time-scale compression process, time-scale expansion process, and process without time-scale modification process, the frame selecting means selecting low-probability frames with priority. Since distortion resulting from time-scale expansion/compression process to frames which contain no voice information is hardly detected, time-scale modified audio of high quality is obtained.

According to a seventh aspect of the present invention, an audio reproducing apparatus comprises audio decoding means for decoding an input audio signal frame by frame; data expanding/compressing means for subjecting data in a decoded frame to time-scale modification process; expansion/compression frequency control means for setting a frame cycle number and the number of frames to be expanded/compressed in the frame cycle according to a given speed rate; stationarity calculating means for calculating stationarities of audio signals in respective frames; frame selecting means for selecting frames to be expanded/compressed according to an output of the stationarity calculating means and an output of the expansion/compression frequency control means; and data expansion/compression control means for instructing the data expanding/compressing means to subject the frame to one of time-scale compression process, time-scale expansion process, and process without time-scale modification process, the frame selecting means selecting high-stationarity frames with priority. Since distortion resulting from weighting addition to high-stationarity frames is hardly detected, time-scale modified audio of high quality is obtained.

According to an eighth aspect of the present invention, an audio reproducing apparatus comprises audio decoding means for decoding an input audio signal frame by frame; data expanding/compressing means for subjecting data in a decoded frame to time-scale modification process; expansion/compression frequency control means for setting a frame cycle number and the number of frames to be expanded/compressed in the frame cycle, according to a given speed rate; means for calculating degrees of energy change of audio signals in respective frames; frame selecting means for selecting frames to be expanded/compressed according to an output of the means for calculating means and an output of the expansion/compression frequency control means; and data expansion/compression control means for instructing the data expanding/compressing means to subject the frame to one of time-scale compression process, time-scale expansion process, and process without time-scale modification process, the frame selecting means selecting frames with priority in which distortion is hardly detected because of masking effects, according to the degrees of energy change. Since distortion is hardly detected because of masking effects, time-scale modified audio of high quality is obtained.

According to a ninth aspect of the present invention, an audio reproducing apparatus comprises audio decoding means for decoding an input audio signal frame by frame; data expanding/compressing means for subjecting data in a decoded frame to time-scale modification process; expansion/compression frequency control means for setting a frame cycle number and the number of frames to be expanded/compressed in the frame cycle, according to a given speed rate; at least two of energy calculating means for calculating energies of audio signals in respective frames, means for calculating probabilities that respective frames contain humane voice, stationarity calculating means for calculating stationarities of audio signals in respective frames, and means for calculating degrees of energy change of audio signals in respective frames; frame selecting means for selecting frames to be expanded/compressed according to outputs of plural calculating means and an output of the expansion/compression frequency control means; and data expansion/compression control means for instructing the data expanding/compressing means to subject the frame to one of time-scale compression process, time-scale expansion process, and process without time-scale modification process, the frame selecting means deciding frames to be selected according to the outputs of the plural calculating means. Therefore, users can select a reproducing method which considers naturalness or reproducing method which considers intelligibility. As a result, time-scale modified audio of high quality is obtained on demand.

According to a tenth aspect of the present invention, in the audio reproducing apparatus of the first to ninth aspects, the audio decoding means for performing decoding frame by frame divides an audio signal into plural subband signals and performs decoding for each of the divided subbands. Therefore, the effects as provided by one of the first to ninth aspects are obtained.

According to an eleventh aspect of the present invention, in the audio reproducing apparatus of the first to tenth aspects, the audio decoding means for performing decoding frame by frame decodes data coded by an MPEG1 audio layer 2 coding method. Therefore, the data coded by the MPEG audio coding method is time-scale modified with less distortion.

According to a twelfth aspect of the present invention, in the audio reproducing apparatus of the fifth aspect, the audio decoding means for performing decoding frame by frame decodes data coded by an MPEG1 audio layer 2 coding method, and the energy calculating means estimates an energy of an audio signal based on a scalefactor index indicating a scalefactor at reproduction. Therefore, the data coded by the MPEG audio coding method is time-scale modified with less distortion.

According to a thirteenth aspect of the present invention, in the audio reproducing apparatus of the seventh aspect, the audio decoding means for performing decoding frame by frame decodes data coded by an MPEG1 audio layer 2 coding method, and the stationarity calculating means estimates a stationarity of an audio signal based on scalefactor selection information indicating waveform statiorarity. Therefore, the data coded by the MPEG audio coding method is time-scale modified with less distortion.

According to a fourteenth aspect of the present invention, in the audio reproducing apparatus of the eighth aspect, the audio decoding means for performing decoding frame by frame decodes data coded by an MPEG1 audio layer 2 coding method, and the means for calculating degrees of energy change estimates a degree of energy change of an audio signal based on a scalefactor index indicating a scalefactor at reproduction. Therefore, the data coded by the MPEG audio coding method is time-scale modified with less distortion.

According to a fifteenth aspect of the present invention, in the audio reproducing apparatus of the ninth aspect, the audio decoding means for performing decoding frame by frame decodes data coded by an MPEG1 audio layer 2 coding method, and the apparatus further comprises at least two of the energy calculating means, stationarity calculating means, and the means for calculating degrees of energy change wherein, the energy calculating means estimates an energy of an audio signal based on a scalefactor index indicating a scalefactor at reproduction, the stationarity calculating means estimates a stationarity of an audio signal based on scalefactor selection information indicating waveform stationarity, and the means for calculating degrees of energy change estimates a degree of energy change of an audio signal based on a scalefactor index indicating a scalefactor at reproduction. Therefore, the data coded by the MPEG audio coding method is time-scale modified with less distortions.

According to a sixteenth aspect of the present invention, in the audio reproducing apparatus of the first to fifteenth aspects, the data expanding/compressing means includes correlation calculating means for calculating correlation between segments in each frame, and a position at which the correlation is high, and sending shift amount by which waveform data of a segment is shifted to the position, the cross fading means shifts the waveform data of the segment according to the shift amount, and performs weighting addition to each segment data, and for a subsequent frame to be subjected to time-scale compression/expansion, segment data is shifted and subjected to weighting addition, considering the shift amount of a frame which has been previously subjected to time-scale compression/expansion. Therefore, waveform data is shifted to high correlation position, and time-scale compression/expansion is performed considering the shift amount.

According to a seventeenth aspect of the present invention, in the audio reproducing apparatus of the first aspect, the data expanding/compressing means includes correlation calculating means for finding correlation between segments in each frame, the audio decoding means for performing decoding frame by frame divides an audio signal into plural subband signals and performs decoding for each subband, and the correlation calculating means finds correlation between the segments by the use of data of a subband which contains pitch frequency of an audio signal. Since data of a subband which contains a pitch frequency of an audio signal is found, an audio signal is time-scale modified with less distortion.

According to an eighteenth aspect of the present invention, in the audio reproducing apparatus of the sixteenth aspect, the audio decoding means for performing decoding frame by frame divides an audio signal into plural subband signals and performs decoding for each of the divided subbands, and the correlation calculating means calculates a correlation value for each subband, and weighting addition is performed by using the shift amount of a subband which has the largest correlation value. This correlation operation allows time-scale modification process with less distortion.

According to a nineteenth aspect of the present invention, the audio reproducing apparatus of the sixteenth aspect, the audio decoding means for performing decoding frame by frame divides an audio signal into plural subband signals and performs decoding for each of the divided subbands, and the correlation calculating means calculates correlation for a subband of the divided subbands which has the highest energy. This correlation operation allows time-scale modification process with less distortion.

According to a twentieth aspect of the present invention, in reproducing apparatus as defined in one of the first to fourth aspects or as defined in one of the sixteenth to nineteenth aspects, the frame sequence table includes plural sequence tables having different patterns per one speed rate, the data expanding/compressing means finds an average of correlation values between segments in respective frames to be expanded/compressed for each sequence table, and performs processing with reference to a sequence table in which the average is the largest. Therefore, this expansion/compression process allows time-scale modification process with less distortion.

BRIEF DESCRIPTION OF THE DRAWINGS

FIG. 6 is a diagram showing data compression of the second embodiment.

FIGS. 24(*a*) and 24(*b*) are diagrams showing a state qualitatively in which the segment as the second half signal component is shifted to a time at which the correlation function takes a maximum value.

FIGS. 25(*a*)–25(*c*) are diagrams showing a state in which cross fading process is performed with two segments overlapped for a Tc time period.

DETAILED DESCRIPTION OF THE PREFERRED EMBODIMENTS

Embodiment 1

Figure 1:
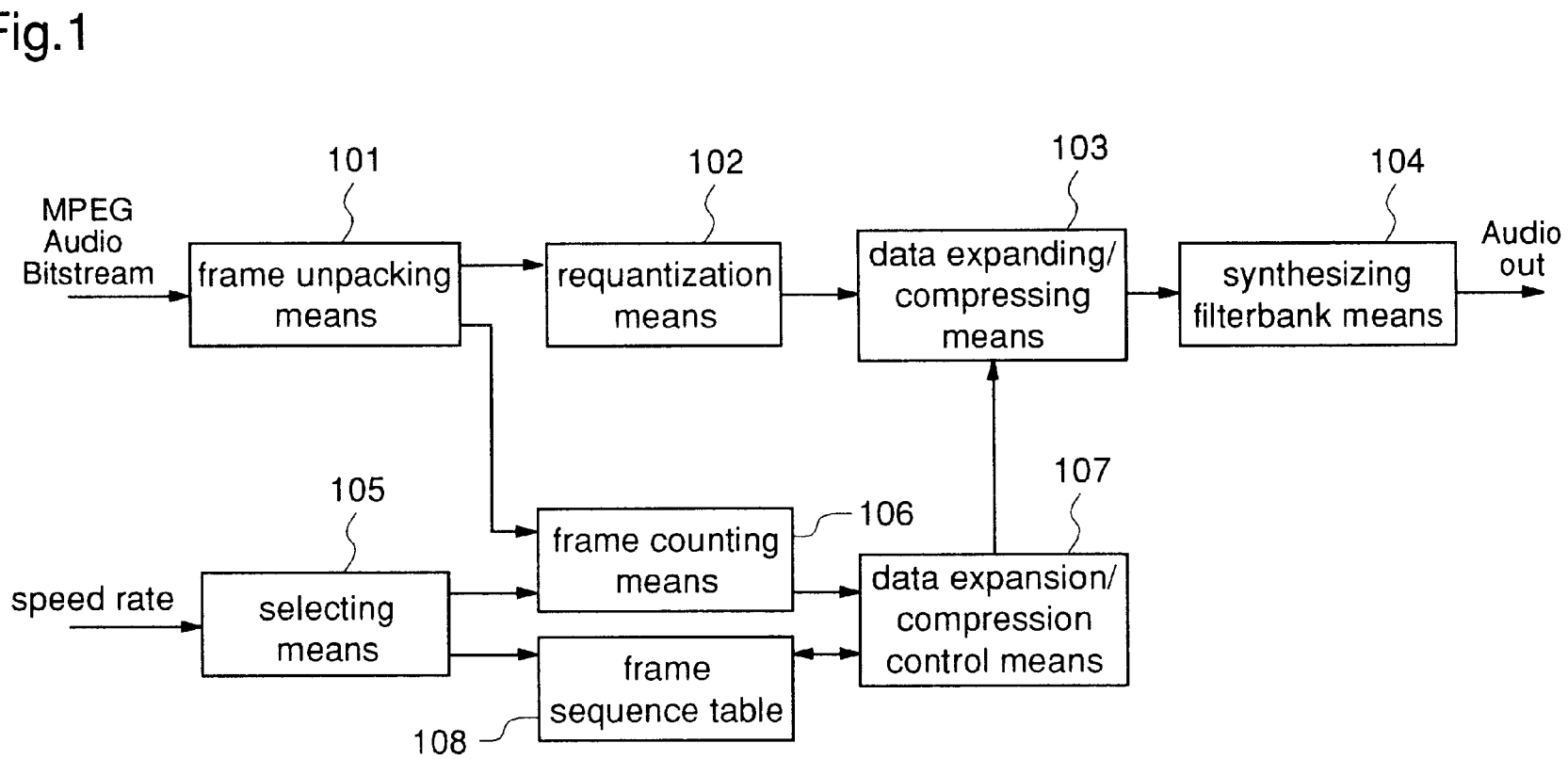
FIG. 1 is a block diagram showing an audio reproducing apparatus according to a first embodiment of the present invention.

Now, preferred embodiments of the present invention will be described with reference to figures. FIG. 1 is a block diagram showing an audio reproducing apparatus according to a first embodiment of the present invention. In FIG. 1, reference numerals 101, 102, 103, 104, 105, 106, 107, and 108 designate frame unpacking means, requantization means, data expanding/compressing means, synthesizing filterbank means, selecting means, frame counting means, data expanding/compressingmeans, and a frame sequence table, respectively. Operation will be described below.

In this embodiment, there is shown an example of an audio reproducing apparatus which performs time-scale modification process to intermediate data of an MPEG1 audio bit stream being decoded. The MPEG1 audio bit stream comprises, a header, bit allocation information, information about a scalefactor, sample data information, and so forth.

Referring to FIG. 1, the input MPEG1 audio bit stream is separated into respective information such as the header, the bit allocation information, the information about the scalefactor, and the sample data information, by the frame unpacking means 101. The requantization means 102 obtains requantized data for each subband based on the bit allocation information of each subband (32 subbands in MPEG1 audio), the information about the scalefactor, or the like, obtained by unpacking.

The data expanding/compressing means 103, when an output of the requantization means 102 corresponds to a frame to be subjected to time-scale compression/expansion, subjects it to time-scale compression/expansion in a fixed ratio, and when the output corresponds to a frame to be output "through" without compression/expansion, the means 103 directly outputs it to the synthesizing filterbank means 104, under the control of data expansion/compression control means 107 mentioned later. The filterbank means 104 synthesizes data of respective input subbands (32 subbands in MPEG1 audio), and outputs the resulting synthesized audio signal.

Figure 2:
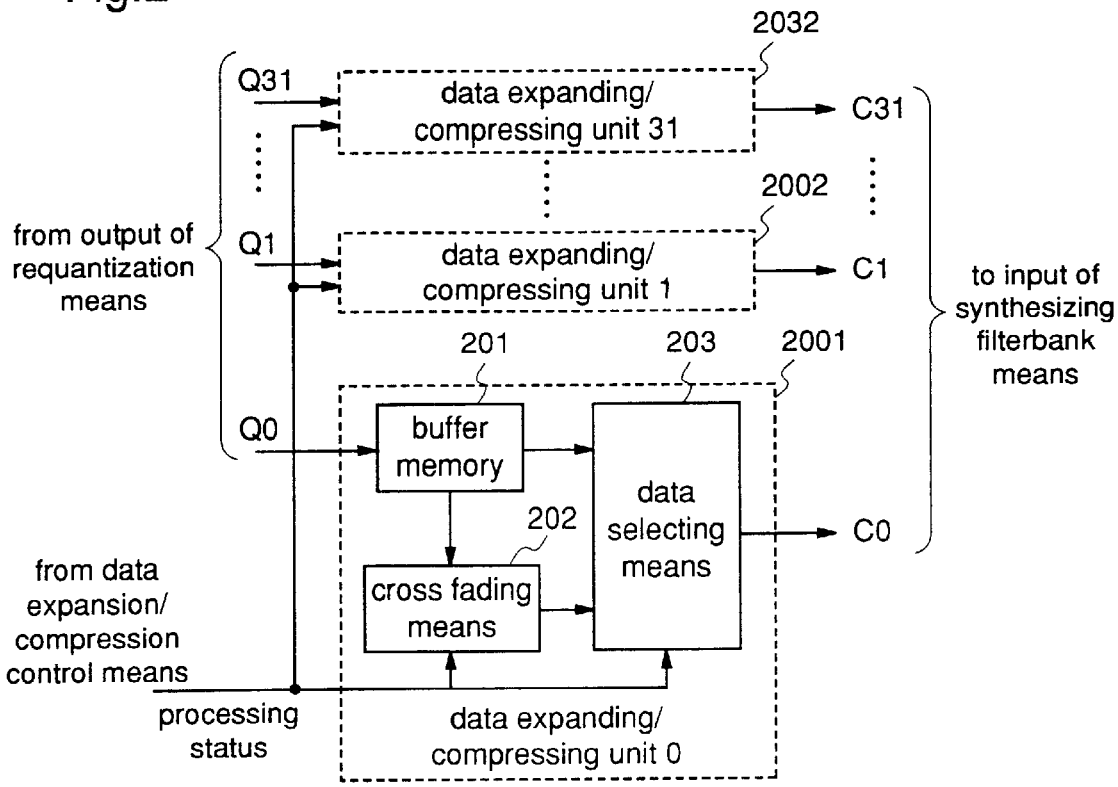
FIG. 2 is a diagram showing construction of data expanding/compressing means of the first embodiment.

FIG. 2 shows an internal structure of the data expanding/compressing means 103. In FIG. 2, reference numeral 2001 designates a data expanding/compressing unit, 0 which processes an output Q0 of the lowest subband of the requantization means 102, and the following numerals 2002, . . . , 2032 designate data expanding/compressing units. 1, . . . 31, which process outputs Q1, . . . , Q31 of the second lowest to the highest subbands, respectively, of the requantization means 102. As shown in FIG. 2, these data units each comprises a buffer memory 201, cross fading means 202, and data selecting means 203. The data expanding/compressing units 1–31 have structures identical to that of the data expanding/compressing unit 0, and therefore they are omitted in the figure.

Hereinafter, a description is given of how the data: expanding/compressing unit 0 operates to process the output data Q0 of the lowest frequency subband of the requantization means 102. The output Q0 of the requantization means 102, one frame data (data of a prescribed time length) of which is temporarily stored in the buffer memory 201. Here it is assumed that the number of one frame data of each subband is "Ns". When the data corresponds to the frame to be output "through", in accordance with a control signal output from the data expansion/compression control means 107, the data selecting means 203 outputs "Ns" pieces of data written in the buffer memory 201 to the synthesizing filterbank means 104. On the other hand, when the data corresponds to the frame to be subjected to time-scale compression/expansion, in accordance with the control signal, the cross fading means 202 subjects the Ns pieces of data in the buffer memory 201 to time-scale compression/expansion in a prescribed ratio Sr.

Figure 3:
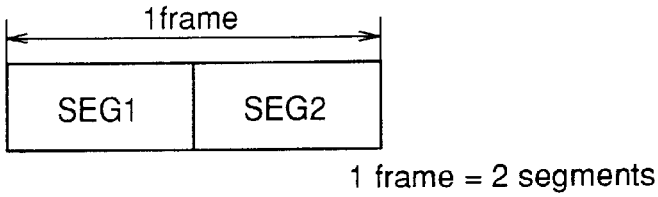
FIGS. 3(*a*)–3(*c*) are diagrams showing states fixed value time-scale compression/expansion in data expanding/compressing means of the first embodiment.
Figure 3:
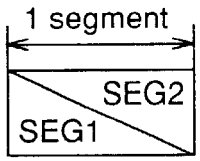
Figure 3:
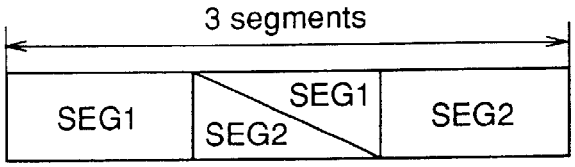

Subsequently, a description is given of cross fading process by the cross fading means, i.e., a method for performing time-scale compression/expansion, with reference to FIGS. 3(*a*)–3(*c*). FIGS. 3(*a*)–3(*c*) are diagrams which schematically show a state in which a data length of a frame varies by time-scale compression/expansion. FIG. 3(*a*) shows a normal frame, in which Ns pieces of data of one frame is divided into segments SEG1 and SEG2 which are equal in the number of data (the same time length). Based on these segments, weighting addition in FIGS. 3(*b*) and 3(*c*), i.e., cross fading process is performed to reduce/increase the number of data with no discontinuity. Compression is performed as shown in FIG. 3(*b*), and expansion is performed as shown in FIG. 3(*c*). In the case of a frame to be output "through" without cross fading process, a frame signal in FIG. 3(*a*) is directly output from the data expanding/compressing means 103 to the synthesizing filterbank means 104. Shown in FIG. 3(*b*) is an example of a frame which has been subjected to time-scale compression in the compression ratio (=1/speed rate) of ½. Shown in FIG. 3(*c*) is an example of a frame which has been subjected to time-scale expansion in the expansion ratio of 3/2. The compression/expansion ratio is defined as:

The compression/expansion ratio=1/speed rate=the number of data output from the cross fading means/the number of data input to the cross fading means.

The compression shown in FIG. 3(*b*) of all the frames results in reproduced audio at a fixed speed rate of 2.0.

The expansion shown in FIG. 3(*c*) of all the frames results in reproduced audio at a fixed speed rate of ⅔.

To realize such time-scale modification, the control signal indicating compression/expansion/through is sent from the data expansion/compression control means 107 to the data expanding/compressing means 103, and by the control signal, respective data expanding/compressing units are controlled. For instance, to realize the speed rate "2.0", according to input speed rate information (=2.0), the control signal indicating "compression with speed rate=2.0" is output to the data expanding/compressing means 103. Receiving the control signal, the cross fading means 202 performs cross fading process in FIG. 3(*b*) to all the frames, and then the data selecting means 203 selects an output of the cross fading means 202 and outputs it to the synthesizing filterbank means 104. To realize the speed rate "⅔ (=0.66)", according to input speed rate information (=⅔), the control signal indicating "expansion with speed rate=⅔" is output to the data expanding/compressing means 103. Receiving the control signal, the cross fading means 202 performs cross fading process in FIG. 3(*c*) to all the frames, and then the data selecting means 203 selects an output of the cross fading means 202 and outputs it to the synthesizing filterbank means 104.

To realize audio with speed rates other than the above, process is repeated to specific frames rather than all the frames in the sequence in which time-scale compression/ expansion in FIGS. 3(*b*)/3(*c*) is performed until desired reproducing speeds which differ from speed rates for respective frames can be obtained. This will be described with reference to FIGS. 4(*a*)–4(*f*).

Figure 4:
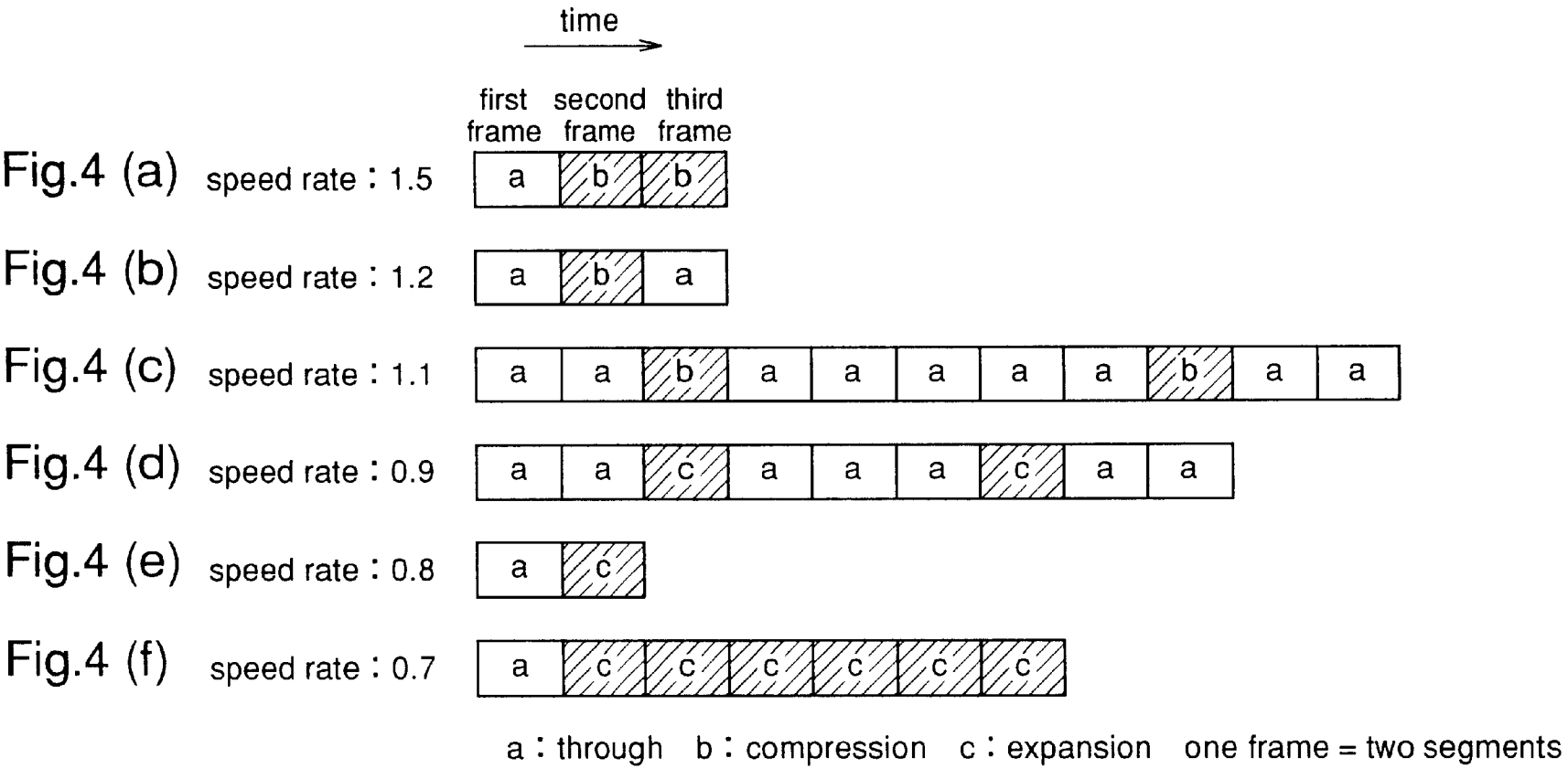
FIGS. 4(*a*)–4(*f*) are diagrams showing expansion/compression sequences of the first embodiment.

FIGS. 4(*a*)–4(*f*) are process sequence diagrams for explaining time-scale compression/expansion process (speed rate=1.5, 1.2, 1.1, 0.9, 0.8, 0.7). In the figures, (a) indicates a frame to be output "through" (without time-scale compression/expansion), (b) indicates a frame to be subjected to time-scale compression, and (c) indicates a frame to be subjected to time-scale expansion. Table 2 shows the number of input segments, the number of output segments, the number of segments to be subjected to compression/expansion, and a frame cycle for repetition, for the case of the speed rates shown in FIGS. 4(*a*)–4(*f*).

TABLE 2

| Speed rate | 0.7 | 0.8 | 0.9 | 1.1 | 1.2 | 1.5 |
|---|---|---|---|---|---|---|
| Number of input segments | 14 | 4 | 18 | 22 | 6 | 6 |
| number of output segments | 20 | 5 | 20 | 20 | 5 | 4 |
| number of segments to be compressed/expanded | 6 | 1 | 2 | −2 | −1 | −2 |
| frame cycle | 7 | 2 | 9 | 11 | 3 | 3 |

The frames shown in FIGS. 4 (*a*)–4(*f*) are each composed of two segments which are equal in the number of data (equal in time length), as shown in FIG. 3(*a*). The number of input segments, the number of output segments, and the number of segments to-be-expanded/compressed with respective speed rates shown in FIGS. 4(*a*)–4(*f*) are shown in table 2. For example, in case of the speed rate "1.5", as shown in FIG. 4(*a*), the first to third frames are input, and therefore the number of input segments is 3 frames ×2 segments=6 segments. In this case, since the second and third frames are subjected to time-scale compression, and thereby the number of segments of each frame changes from 2 into 1, the number of segments to-be-compressed becomes "2". As a result, the number of output segments is, 6 segments −2 segments=4 segments. The speed rate is given by (the number of input segments/the number of output segments). Further, table 3 shows an example of a frame sequence table 108 for frames shown in FIGS. 4(*a*)–4(*f*). Entered in this table are the speed rates, frame cycles counted by the frame counting means 106, and sequences (frame sequences) of compression/expansion/through process for respective frames.

In the table 3, "a", "b", and "c" indicate "through", "compression", and "expansion", respectively.

TABLE 3

| speed rate | frame cycle | frame sequence |
|---|---|---|
| 0.7 | 7 | a, c, c, c, c, c, c |
| 0.8 | 2 | a, c |
| 0.9 | 9 | a, a, c, a, a, a, c, a, a |
| 1.1 | 11 | a, a, b, a, a, a, a, a, b, a, a |
| 1.2 | 3 | a, b, a |
| 1.5 | 3 | a, b, b |

a: through
b: compression
c: expansion

Initially, desired speed rate information is input to the selecting means 105. In this illustrated example, the information is speed rate=1.1, speed rate=0.7, or the like. Receiving the speed rate information as an input, the selecting means 105 sends a frame cycle to the frame counting means 106 and a frame sequence to the frame sequence table 108. The frame cycle and the frame sequence, the values of which are shown in table 3.

Hereinafter, a description is given of an example in which a reproducing time is reduced (speed rate >1.0 time-scale compression). Here it is assumed that the speed rate is "1.1".

When the speed rate information "1.1" is input to the selecting means 105, it sends a frame cycle "11" to the frame counting means 106 and a frame sequence "a, a, b, a, a, a, a, a, b, a, a" to the frame sequence table 108. The frame sequence is written onto the frame sequence table 108. The frame counting means 106, after it has received the frame cycle "11" from the selecting means 105, counts frames output from the frame unpacking means 101 and input thereto, and outputs the value of counted frames. At this time, the value is counted by the frame counting means 106 in 11 cycles (1→2→. . . →10→11→1→. . . ).

When the count value "1" is input, the data expansion/compression control means 107 reads a first sequence "a" of the frame sequence from the frame sequence table 108, and outputs a control signal for instructing the data expanding/compressing means 103 to perform "through" process. In the data expanding/compressing means 103, according to the control signal indicating "through", respective data selecting means outputs Q0, Q1, . . . , Q31 data output from the requantization means 102 as C0, C1, . . . , C31, "through" (without cross fading). The synthesizing filterbank means 104 performs synthesis based on the data C0, C1, . . . , C31 of 32 subbands and outputs an audio output of the frame.

Subsequently, when a count value "2" is output from the frame counting means 106, the data expansion/compression control means 107 reads a second sequence "a" of the frame sequence from the frame sequence table 108, and outputs a control signal for instructing the data expanding/compressing means 103 to perform "through" process. The following processing is performed as in the case of the count value "1". As is apparent from FIG. 4 and table 3, when a count value is "4", "5", "6", "7", "8", "10", or "11", a sequence read from the frame sequence table 108 is "a". In this case, processing is performed as in the case of the count value "1", and therefore will not be described herein.

From FIG. 4 and table 3, when the count value is "3", or "9", a sequence "b" is read from the frame sequence table 108, and time-scale compression is carried out. This will be described below.

When the frame counting means 106 outputs the count value "3" or "9", the data expansion/compression control means 107 reads a frame sequence "b" from the table 108, and outputs a control signal for instructing the data expanding/compressing means 103 to perform "compression" process. In the data expanding/compressing means 103, in accordance with the control signal indicating "compression", respective cross fading means in data expanding/compressing units 0–31 performs time-scale compression as already described by means of FIG. 3(*b*), and the data selecting means 203 selects and outputs the resulting compressed signals (C0, C1, . . . C31). The synthesizing filterbank means 104 performs synthesis based on C0, C1, . . . , C31 data of 32 subbands and outputs an audio output of the frame.

Respective frames are thus subjected to "through", or "time-scale compression" process, and one cycle processing is performed in a frame sequence "11". Upon completion of this one cycle processing, the following input frames are processed in the same sequence.

Subsequently, a description is given an example where a reproducing speed is reduced (speed rate <1.0; time-scale expansion). Here it is assumed that the speed rate is "0.7".

When the speed rate information "0.7" is input to the selecting means 105, it sends a frame cycle "7" to the frame counting means 106 and a frame sequence "a, c, c, c, c, c, c " to the frame sequence table 108. This frame sequence is written to the frame sequence table 108. The frame counting means 106, after it has received the frame cycle "7" from the selecting means 105, counts frames output from the frame unpacking means 101 and input thereto, and outputs the value of counted frames. At this time, the value is counted by the frame counting means 106 in seven cycles (1→2→. . . →6→7→1→. . . ).

When the count value "1" is input, the data expansion/compression control means 107 reads a first sequence "a" of the frame sequence from the frame sequence table 108, and outputs a control signal for instructing the data expanding/compressing means 103 to perform "through"process. In the data expanding/compressing means 103, according to the control signal indicating "through", respective data selecting means outputs Q0, Q1 . . . , Q31 data output from the requantization means 102 "through" (without cross fading). The synthesizing filterbank means 104 performs synthesis based on the data C0, C1, . . . , C31 of 32 subbands and outputs an audio output of the frame.

Subsequently, when the count value "2" is output from the frame counting means 106, the data expansion/compression control means 107 reads a frame sequence "c" from the frame sequence table 108 and performs time-scale expansion. This will be described below.

When the count value "2" is output from the frame counting means 106, the data expansion/compression control means 107 reads a frame sequence "c" from the frame sequence table 108, and outputs a control signal for instructing the data expanding/compressing means 103 to perform "expansion" process. In the data expanding means 103, respective cross fading means in the data expanding/compressing units 0–31 performs time-scale expansion as already described by means of FIG. 3(*c*), and the data selecting means 203 selects and outputs the resulting expanded signals (C0, C1, . . . , C31) The synthesizing filterbank means 104 performs synthesis based on C0, C1, . . . , C31 of 32 subbands and outputs an audio output of the frame.

Subsequently, the count value "3" is output from the frame counting means 106. As is apparent from FIG. 4 and table 3, when the count value is "3", "4", "5", "6", or "7", a sequence read from the frame sequence table 108 is "c" as in the case of the second frame, and processing hereof is performed as in the case of the count value "2", and therefore will not be described herein.

Respective frames are thus subjected to "through", or "time-scale expansion" process, and one cycle processing is performed in a frame sequence "7". Upon completion of this one cycle processing, the following input frames are processed in the same sequence.

As should be appreciated from the forgoing description, frames to-be-subjected to time-scale compression/expansion process are inserted uniformly to make data (segments) with a desired speed rate in a frame cycle, whereby a desired speed rate in a specific frame cycle is obtained. Besides, for the case of a speed rate different from those of examples of (table 2) and (table 3), a frame cycle is repeated according to the sequence table into which frames to-be-subjected to time-scale compression/expansion process are inserted uniformly so as to conform to the speed rate, whereby audio with a desired speed rate is obtained. Moreover, in case of a sequence pattern different from those shown in FIGS. 4(*a*)–4(*f*), table 2, and table 3, a desired speed rate is obtained so long as the number of segments to-be-subjected to compression/expansion process is as shown in table 2.

Thus, control is performed so that frames are subjected to time-scale compression/expansion process at fixed values (in the compression ratio of 1/2 and in the expansion ratio of 3/2 as shown in FIGS. 3(*b*) and 3(*c*) in this embodiment) in a prescribed sequence, whereby audio with a desired speed rate is obtained.

While the description has been given of the case where the time-scale compression ratio 1/2 and the time-scale expansion ratio 3/2 are used as references, the sequence table may be created based on the other time-scale compression/expansion ratios.

Embodiment 2

A description is given of a second embodiment of the present invention with reference to figures. An audio reproducing apparatus of the second embodiment has construction identical to that of the first embodiment (see FIG. 1), and is adapted to receive an MPEG1 audio stream. as an input. The frame unpacking means 101, the requantization means 102, the synthesizing filterbank means 104, the selecting means 105, the frame counting means 106, the frame sequence table 108, and the data expansion/compression control means 107 operates in the same manner that the corresponding means of the first embodiment operates. In brief, the second embodiment differs from the first embodiment in an internal structure and operation of: the data expanding/compressing means 103.

Figure 5:
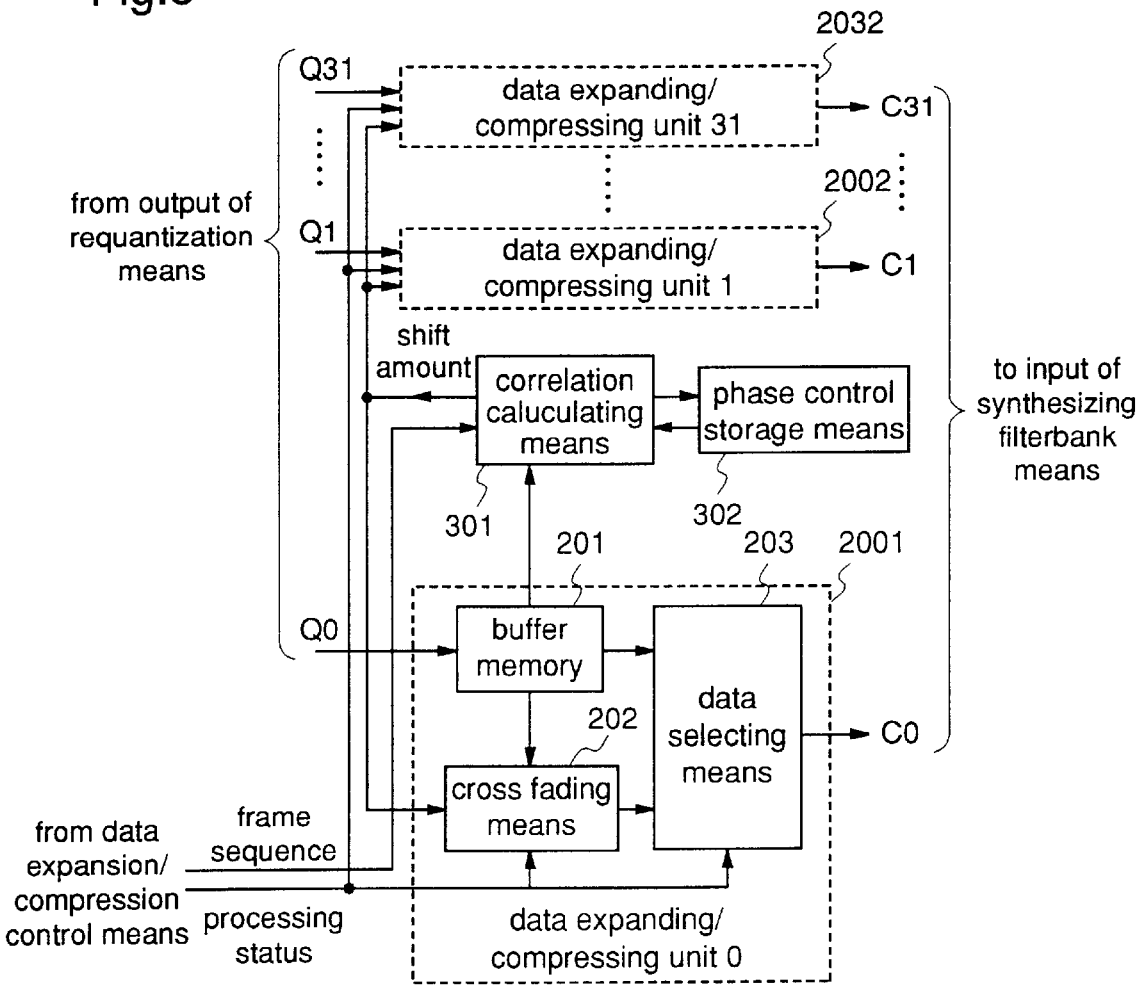
FIG. 5 is a diagram showing construction of data expanding/compressing means of a second embodiment.

FIG. 5 shows a structure of the data expanding/compressing means of the second embodiment.

In the figure, reference numeral 2001 designates an expanding/compressing unit 0 which processes an output Q0 of the lowest subband, of the requantization means 102. The following numerals 2002, . . . , 2032 designate data expanding/compressing units 1, . . . , 31, which process outputs Q1, . . . , Q31 of the second lowest to the highest subbands, of the requantization means 102. As shown in FIG. 5, these data expanding/compressing units each comprises a buffer memory 201, cross fading means 202, and data selecting means 203. The data expanding/compressing units 1–31 have internal structures identical to that of the unit 0,and therefore they are omitted in the figure. In this embodiment, correlation calculating means 301 and phase control storage means 302 are added to the structure.

Hereinafter, a description is in large part given of operation of the correlation calculating means 301 and the phase control storage means 302. In the first embodiment, time-scale waveform cross fading process is carried out by performing weighting addition at uniquely fixed positions. In that case, although amplitude of waveform is connected to each other with no discontinuity, this is not taken into account for phase. Hence, in this embodiment, a position where phase matching is high is found by the use of a correlation function, to which a segment is shifted and then cross fading is performed by weighting addition or the like. FIGS. 6(*a*)–6(*d*) show an example of cross fading (compression) by such weighting addition. FIG. 6(*a*) shows a frame before cross fading, which corresponds to the frame shown in FIG. 3(*a*), and is composed of segments 1 and 2 which are equal in the number of data. FIG. 6(*b*) shows that segments 1 and 2 have been subjected to weighting addition without being shifted considering correlation, which corresponds to the compressed frame in FIG. 3(*b*) and is assumed to be a reference form. FIG. 6(*c*) shows that a frame in which high correlation is positioned at the right of that of the reference form, has been subjected to cross fading, its cross fading interval is shorter than that of the reference in FIG. 3(*b*), and amount of data is more than that of the reference form in FIG. 3(*b*). Conversely, FIG. 6(*d*) shows that a frame in which high correlation is positioned at the left of that of the reference form, has been subjected to cross fading, its cross fading interval is shorter than that of the reference in FIG. 6(*b*), and amount of data is less than that of the reference form in FIG. 3(*b*).

As concerns a time-scale modification apparatus which performs cross fading by the use of a correlation function for improved phase matching, a variety of proposals have been made by inventors of the present invention. For example, these are described in Japanese Published Patent Application No.4-104200 (U.S. Pat. No. 2,532,731) by the inventors. In this embodiment, a cross fading method by the use of the correlation function is employed. Since it is assumed that the data Q0 of the lowest subband includes a range where audio pitch frequency is present, in order to improve phase matching with respect to components corresponding to the pitch frequency, the correlation calculating means 301 and the phase control storage means 302 perform calculation only on subband data corresponding to the data Q0. The data on which correlation calculation is to be performed, is contained in the memory 201. The range for correlation calculation is, as described in the Japanese Published Patent Application No. Hei 4-104200, determined depending upon whether a given frame sequence value indicates a frame to be expanded/compressed, and shift amount found previously.

As can be seen from FIGS. 6(*c*) and 6(*d*), shift to a high correlation position, causes shortage in the target number of data (see FIG. 6(*b*)). The value of this shortage is found from amount of data shifted to the high correlation position (suppose that the amount of correlation shift is "rk".), and this is compensated in subsequent time-scale compression/expansion process. To realize this, it is required that the amount of correlation shift "rk" be temporarily stored in the phase control storage means 302. The amount of correlation shift "rk" can be corrected by adjusting a position (pointer) of head data to be added in subsequent cross fading process.

Figure 7:
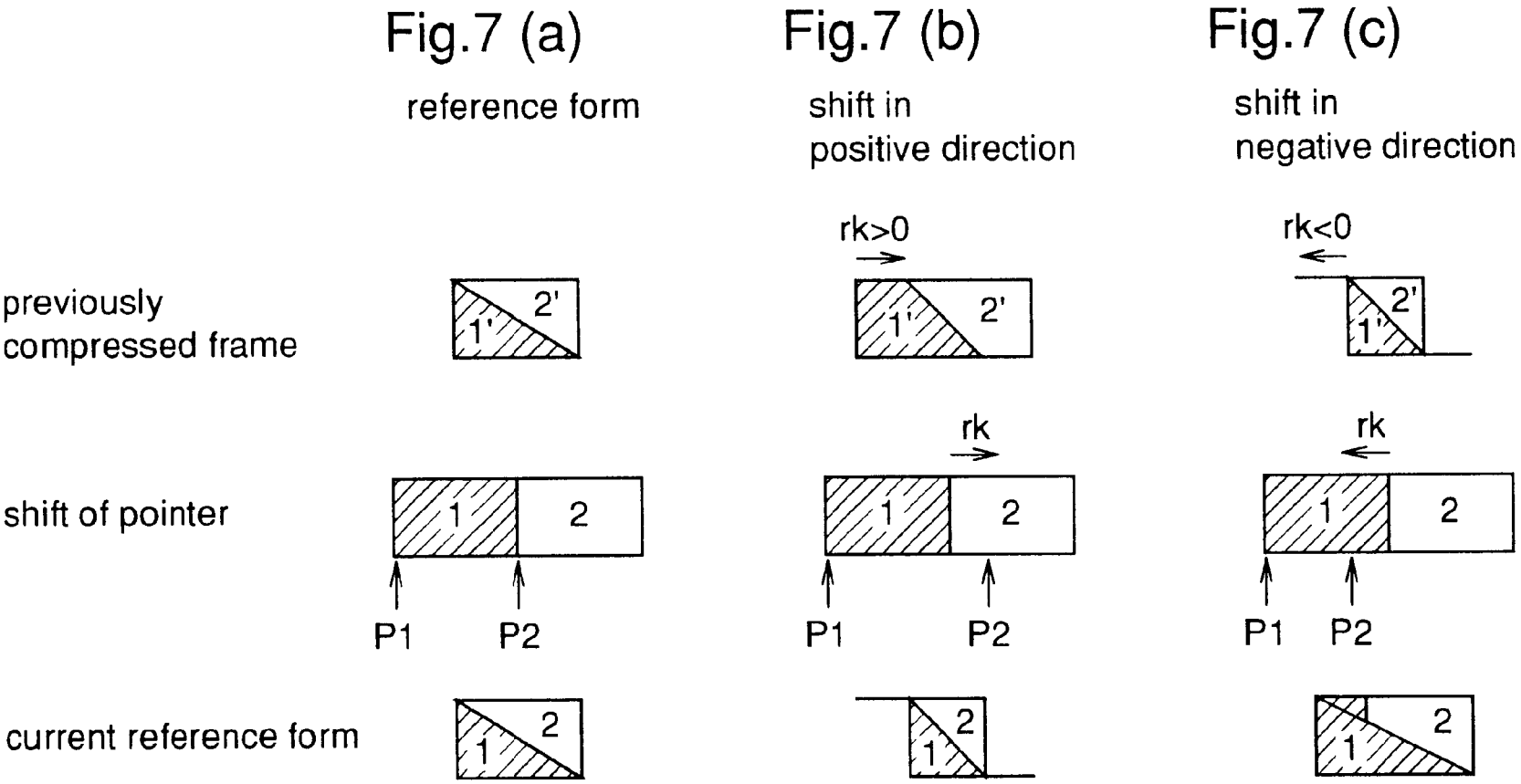
FIGS. 7(*a*)–7(*c*) are diagrams showing correction of data compression of the second embodiment.

FIGS. 7(*a*)–7(*c*) schematically show correction of the shift amount "rk". In a case where there occurred no shift in a previously compressed frame as shown by the reference form in FIG. 7(*a*), a pointer P2 is not shifted and a high correlation position is retrieved as shown in the figure, so that segments 1 and 2 of a current reference form are subjected to cross fading without shift. In a case where weighting addition has been performed at a position shifted in the positive direction (rk>0) as shown by a previously compressed frame in FIG. 7(*b*), since data has been excessively output previously, a pointer P2 is shifted in the positive direction, and a back portion of the segment 1, and a front portion of the segment 2 are not used, as shown by a current reference form in FIG. 7(*b*). In a case where weighting addition has been performed at a position shifted in the negative direction (rk<0) as shown in FIG. 7(*c*), since data ran out previously, a pointer P2 is shifted in the negative direction, and a back portion of the segment 1 is used several times (in this case twice), as shown by a current reference form in FIG. 7(*c*). In any case, when the reference form of the current frame has been compressed by processing in FIGS. 7(*a*)–7(*c*), an error between amount of data of the previous frame and target amount of data has been corrected, and therefore the error has not accumulated. In the example shown, the description has been given of the compressed frames. Needless to say, expanded frames are realized in the same manner. Thus, by using a shifted pointer as a reference considering the shift amount of a previously compressed/expanded frame, the high correlation position is found according to the correlation function.

The correlation shift amount "rk" so found is applied to another subband in the same manner for cross fading process. Data Q1–Q31 is processed in the same manner that the data Q0 is subjected to cross fading process. In respective subbands, cross fading process is performed using the same shift amount "rk", and then output signals C0–C31 are synthesized.

Thus, in accordance with the second embodiment, the position where phase matching is high is found, and cross fading process is performed by performing weighting addition at the position, by the use of the correlation calculating means 301, and thereby amplitude and phase of an output signal of the data expanding/compressing means 103 are respectively connected to those of frames with no discontinuity. As a result, audio quality is improved.

In the second embodiment, the correlation function is found for requantized output data Q0 of the lowest band, and an aim of this embodiment is to achieve improvement of phase matching based on audio basic frequency. However, for the case of an audio source other than a speech signal, which is coded according to MPEG, finding the correlation function for the lowest subband does not always lead to a good result. Instead, high correlation positions are found for respective output data of the respective subbands (Q0–Q31 in the first and second embodiments) of the requantization means, and based on the largest correlation value of largest correlation values for respective subbands, the shift amount for weighting addition is determined, thereby improving phase matching in a subband with high periodicity. Besides, averaged energies are found for respective subbands and then a high correlation position for a subband with the largest average is found, thereby achieving improvement as well.

Figure 8:
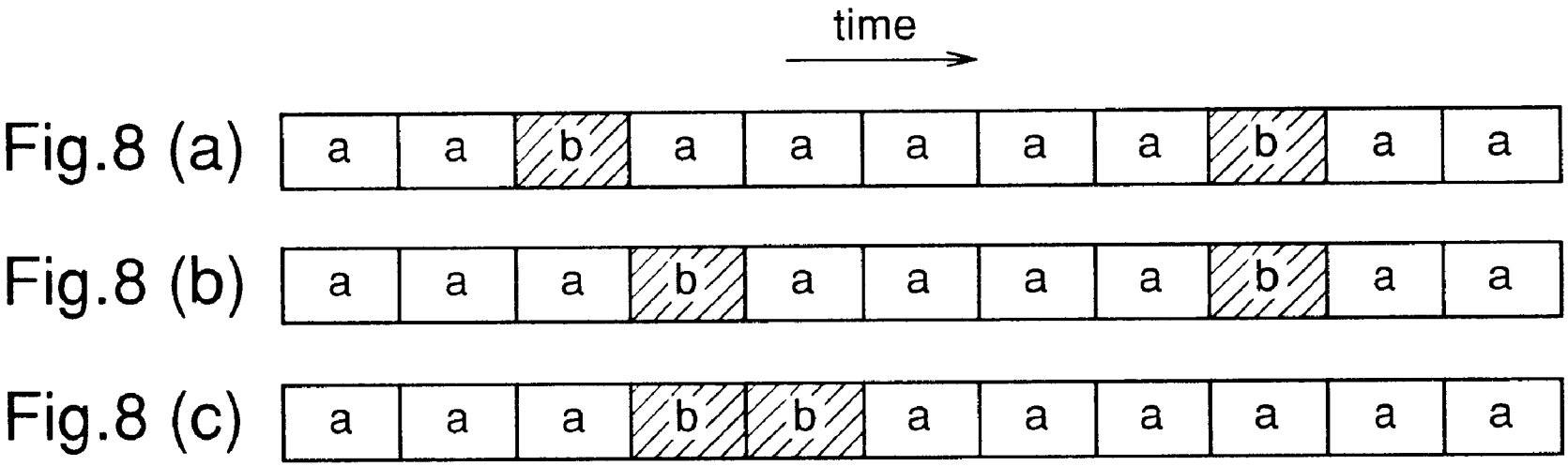
FIGS. 8(*a*)–8(*c*) are diagrams showing another expansion/compression sequences of the second embodiment.

Further, instead of using a one-to-one correspondence between the speed rates and the frame sequences as described in the second embodiment, plural frame sequence tables in which expanded/compressed frames are generated at different positions, may be prepared for one speed rate (speed rate 1.1 in an example shown in FIGS. 8(*a*)–8(*c*)), correlation values for the frames are averaged for each frame sequence table, and with reference to a sequence table with the highest average, expansion/compression is carried out, to generate expanded/compressed frames at optimal positions, thereby improving phase matching. Moreover, the method for adopting the largest correlation value and this method may be used in combination to achieve further improvement.

Embodiment 3

Figure 9:
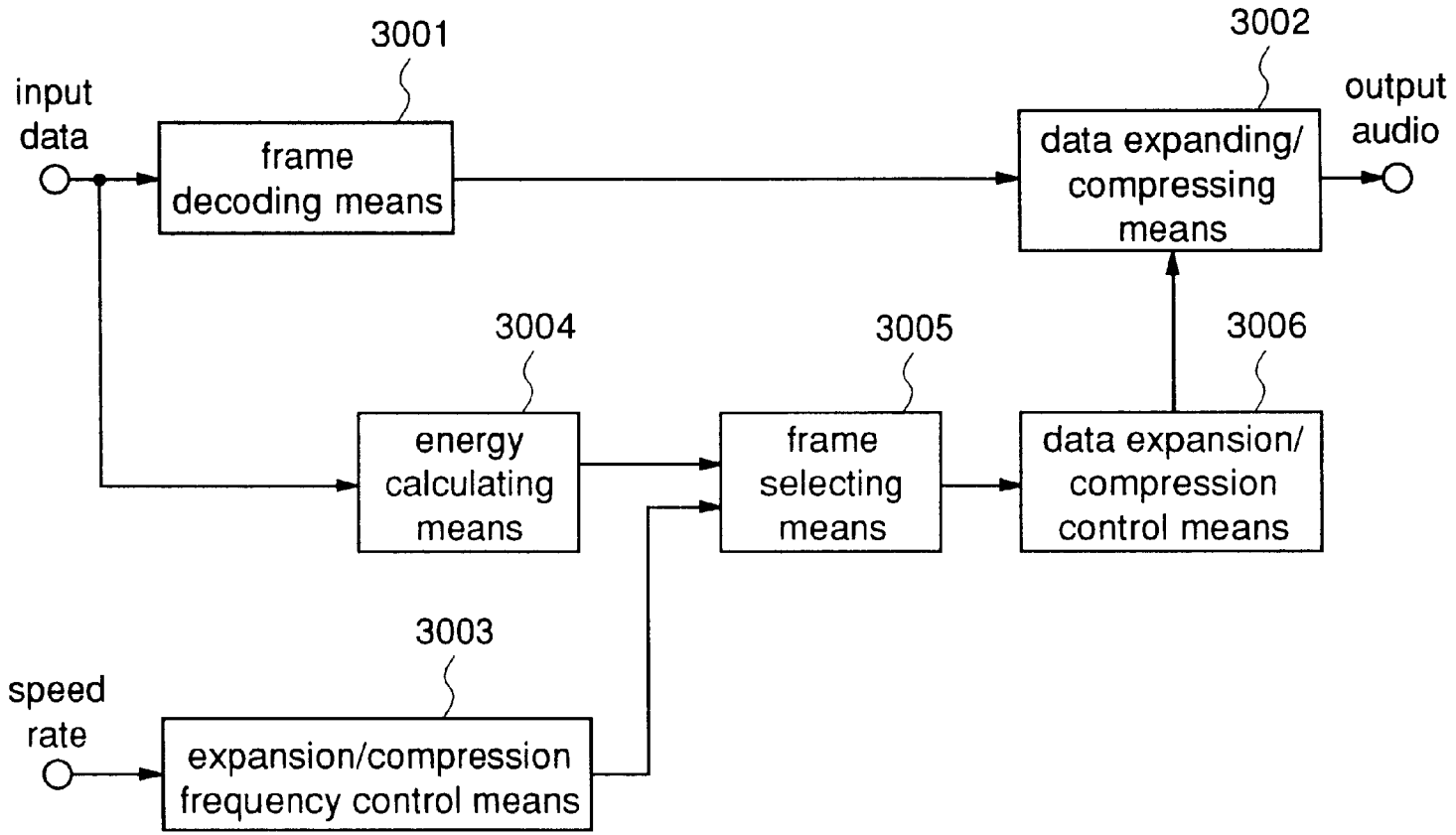
FIG. 9 is a block diagram showing an audio reproducing apparatus according to a third embodiment of the present invention.

A description is given of a third embodiment of the present invention with reference to figures. FIG. 9 is a block diagram showing an audio reproducing apparatus of the third embodiment. In the figure, reference numerals 3001, 3002, 3003, 3004, 3005, and 3006 designate frame decoding means, data expanding/compressing means, expansion/compression frequency control means, energy calculating means, frame selecting means, and data expansion/compression control means, respectively. Operation will be described below.

In the third embodiment, there is illustrated an audio reproducing apparatus which performs time-scale modification process to audio to-be-decoded frame by frame.

Referring to FIG. 9, the expansion/compression frequency control means 3003 outputs a frame cycle number "Nf" corresponding to one cycle in which a series of time-scale modification process is performed, and the number of frames "Ns" to be expanded/compressed in the frame cycle according to given speed rate information.

The energy calculating means 3004 finds audio energies of the frame cycle number which has been decided by the frequency control means 3003. The frame selecting means 3005, on assumption that a frame in no audio state in which no audio is present has a low energy and distortion resulting from expanding/compressing the frame is hardly detected, selects a prescribed number "Ns" of frames with priority in ascending order of energies, with reference to the "Ns"energy values. The control means 3006 decides whether or not the selected frames are frames to be expanded/compressed, and controls expansion/compression of the data expanding/compressing means 3002. Input coded data is decoded by the frame decoding means 3001 frame by frame, and the frames to be expanded/compressed according to the decision by the control means 3006 are subjected to waveform expansion/compression process, and the other frames are directly output. Thus, by the use of audio energies found by the energy calculating means, optimum frames to be expanded/compressed in the frame cycle are selected by the frame selecting means. As a result, distortion of time-scale modified audio resulting from waveform expansion/compression is hardly detected.

Although in the third embodiment, on assumption that the frame in no audio state has a low energy, a prescribed numbers of frames are selected with priority in ascending order of energies as frames to be expanded/compressed, with reference to respective energy values, effectiveness is also provided by the use of the average of amplitudes in each frame.

Embodiment 4

Figure 10:
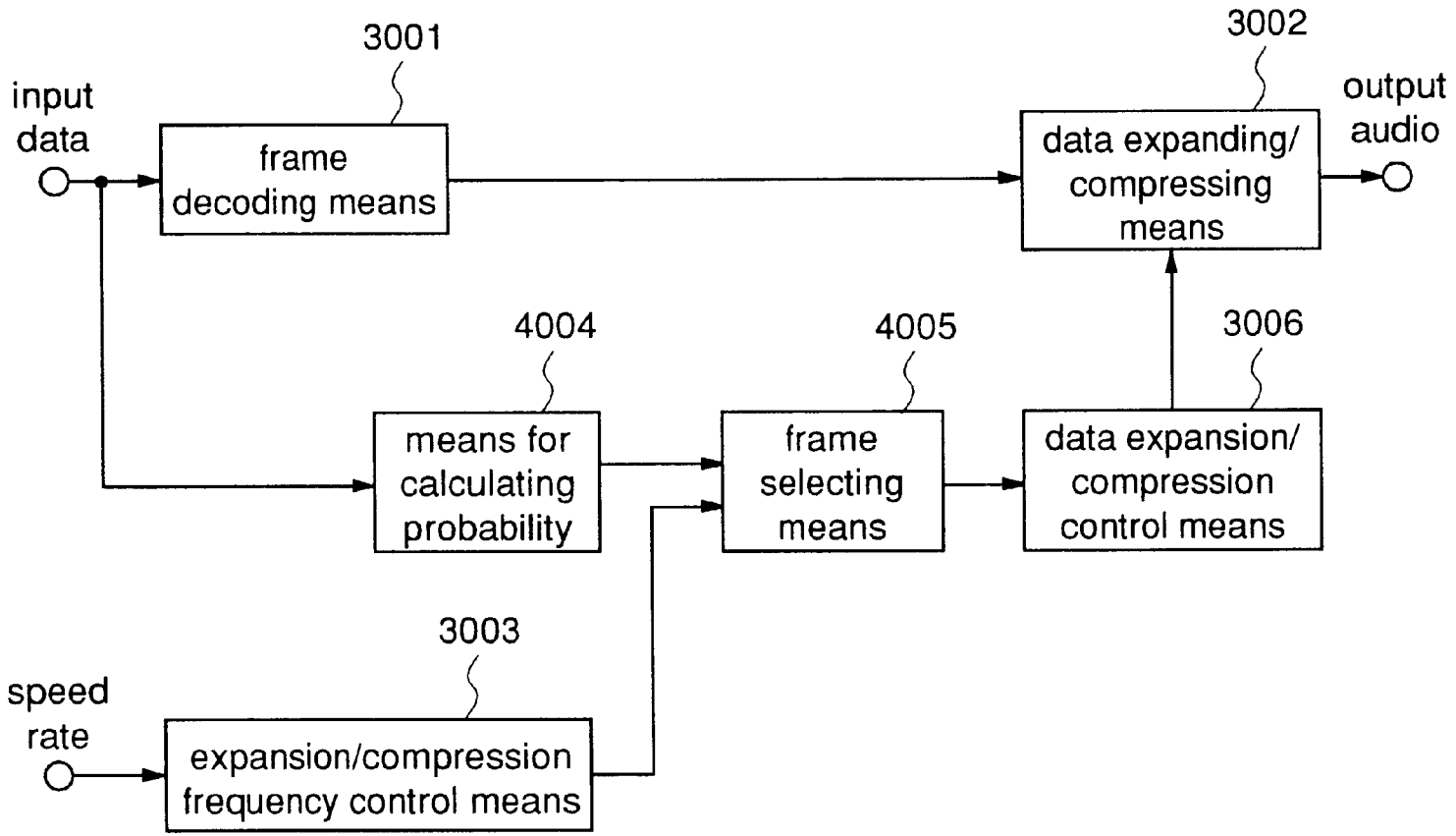
FIG. 10 is a block diagram showing an audio reproducing apparatus according to a fourth embodiment of the present invention.

A description is give of a fourth embodiment with reference to figures. FIG. 10 is a block diagram showing an audio reproducing apparatus according to the fourth embodiment. In the figure, reference numerals 3001, 3002, 3003, 4004, 4005, and 3006 designate frame decoding means, data expanding/compressing means, expansion/compression frequency control means, means for calculating probabilities that frames contain audio signals, frame selecting means, and data expansion/compression control means, respectively. Operation will be described below.

In the fourth embodiment, there is illustrated an audio reproducing apparatus which performs time-scale modification process to audio to be decoded frame by frame.

Referring to FIG. 10, the frame decoding means 3001, the data expanding/compressing means 3002, the expansion/compression frequency control means 3003, and the data expansion/compression control means 3006 operate as in the case of the third embodiment. In the fourth embodiment, a description is in large part given of operation of the frame selecting means 4005 which selects frames to be expanded/compressed.

In this embodiment, according to "probabilities that respective frames contain audio signals", frames to be selected are decided. The "probabilities that respective. frames contain audio signals" "(hereinafter referred to as probability or probabilities)" will now be explained. There is little possibility that an audio signal for communications or broadcasting in real environments is in "no audio state" or in "almost no audio state". The audio signal always contains background noises or non-target audio superposed upon a target audio signal. To reliably select frames containing humane voice, it is required that characteristics of the frames be analyzed from another viewpoint, in addition to largeness of energies. The "probability" is the criterion by which to estimate that a frame contains an audio signal. In a method described in "Study of a Method for deciding audio/noise by fuzzy inference" by Nakato et. al (Electronic Information Communication A-223 1993), frequency at which vowel and unvoiced sound friction sounds occur is fuzzily inferred, to find a probability of voice, and comparison is made between the probability and a predetermined threshold, to decide whether an input signal is voice/noise. Using this "probability" as a criterion indicating possibility that audio is present within a specific time period, a frame which contains audio least likely is estimated even for the case of the voice which contains noise and audio. Besides, degrees of "probabilities" are numerized to be utilized for relative comparison and decision according to largeness of "probabilities" of plural frames.

From analysis of natural voices generated by humane being according to their speeds, it is shown that the voice has a length of pause interval significantly expanded/compressed, during which a vocal organ pauses, other than an audio portion which carries speech information (see "Characteristics of Duration of Phonetic Classification of Continuous Speech" by Hiki et. al). It is therefore desirable that a non-audio portion, i.e., the pause interval, is expanded/compressed to carry out audio time-scale modification process.

The means 4004 calculates "probabilities" of the frame cycle number decided by the expansion/compression frequency control means 3003. The frame selecting means 4005, on assumption that a frame with a low probability has a little audio information and distortion resulting from expanding/compressing the frame is hardly detected, selects a prescribed number "Ns" of frames with priority in ascending order of the probabilities, with reference to the found "Nf"probabilities. The data expansion/compression control means 3006 decides whether or not the selected frames are frames to be expanded/compressed, and controls expansion/compression of the data expanding/compressing means 3002. Input coded data is decoded by the frame decoding means 3001 frame by frame, and the frames to be expanded/compressed according to the decision by he control means 3006 are subjected to waveform expansion/compression, and the other frames are directly output. Thus, by the use of the "probabilities" found by the calculating means 4004, optimum frames to be expanded/compressed in the frame cycle are selected by the frame selecting means. As a result, distortion of time-scale modified audio resulting from waveform expansion/compression is hardly detected.

Embodiment 5

Figure 11:
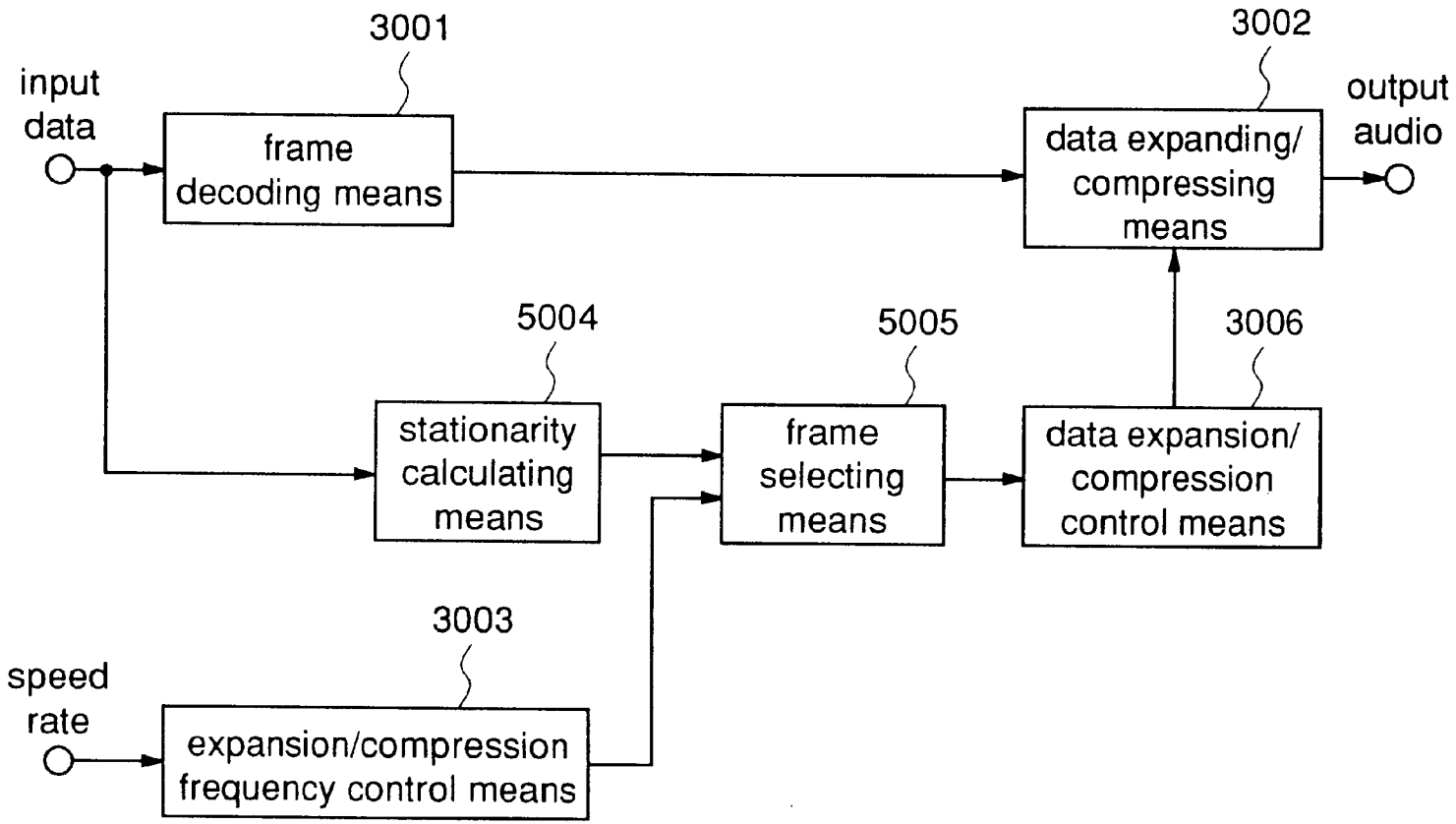
FIG. 11 is a block diagram showing an audio reproducing apparatus according to a fifth embodiment of the present invention.

A description is given of a fifth embodiment of the present invention with reference to figures. FIG. 11 is a block diagram showing an audio reproducing apparatus of the fifth embodiment. In FIG. 11, reference numerals 3001, 3002, 3003, 5004, 5005, and 3006 designate frame decoding means, data expanding/compressing means, expansion/compression frequency control means, stationarity calculating means, frame selecting means, and data expansion/compression control means, respectively. Operation will be described below.

In the fifth embodiment, there is illustrated an audio reproducing apparatus which performs time-scale modification process to audio to be decoded frame by frame.

Referring to FIG. 11, the frame decoding means 3001, the data expanding/compressing means 3002, the expansion/compression frequency control means 3003, and the data expansion/compression control means 3006 operate as in the third embodiment. In this embodiment, a description is in large part given of operation of the frame selecting means which selects frames to be expanded/compressed.

In this embodiment, a "stationarity" of audio waveform is concerned. Here, a normalized autocorrelation in frames is found and it is assumed that larger values have higher stationarities. When performing insertion and reduction of waveform on the basis of a similar interval of time-scale waveform in time-scale expansion/compression process, frames with high correlation are subjected to expansion/compression by weighting addition of waveform. Therefore, frames with high stationarities in which distortion is hardly detected, are selected and subjected to expansion/compression process. Conversely, in an unstationary and transient portion such as a beginning end portion of an audio consonant, distortion resulting from weighting addition thereto is significant.

The stationarity calculating means 5004 finds stationarities of the frame cycle number determined by the expansion/compression frequency control means 3003. Then, the frame selecting means 5005, on assumption that a frame with a high stationarity has a waveform with high periodicity and high similarity and therefore distortion resulting from expanding/compressing the frame is hardly detected, selects a prescribed number "Ns" of frames with priority in descending order of stationarities as frames to be expanded/compressed for time-scale modification, with reference to values for prefound "Nf" stationarities. The data expansion/compression control means 3006 decides whether or not the selected frames are frames to be expanded/compressed and controls expansion/compression of the data expanding/compressing means 3002. Input coded data is decoded by the frame decoding means 3001 frame by frame. The frames to be expanded/compressed according to the decision by the control means 3006 are subjected to waveform expansion/compression, and the other frames are directly output. Thus, by the use of audio stationarities found by the stationarity calculating means, optimum frames 32 to be expanded/compressed in the frame cycle are selected by the frame selecting means. As a result, distortion of time-scale modified audio resulting from waveform expansion/compression process is hardly detected.

While in the fifth embodiment, values for the normalized autocorrelation function are employed as values for stationarities of respective frames, degrees of change in frequency spectrum may be employed.

Embodiment 6

Figure 12:
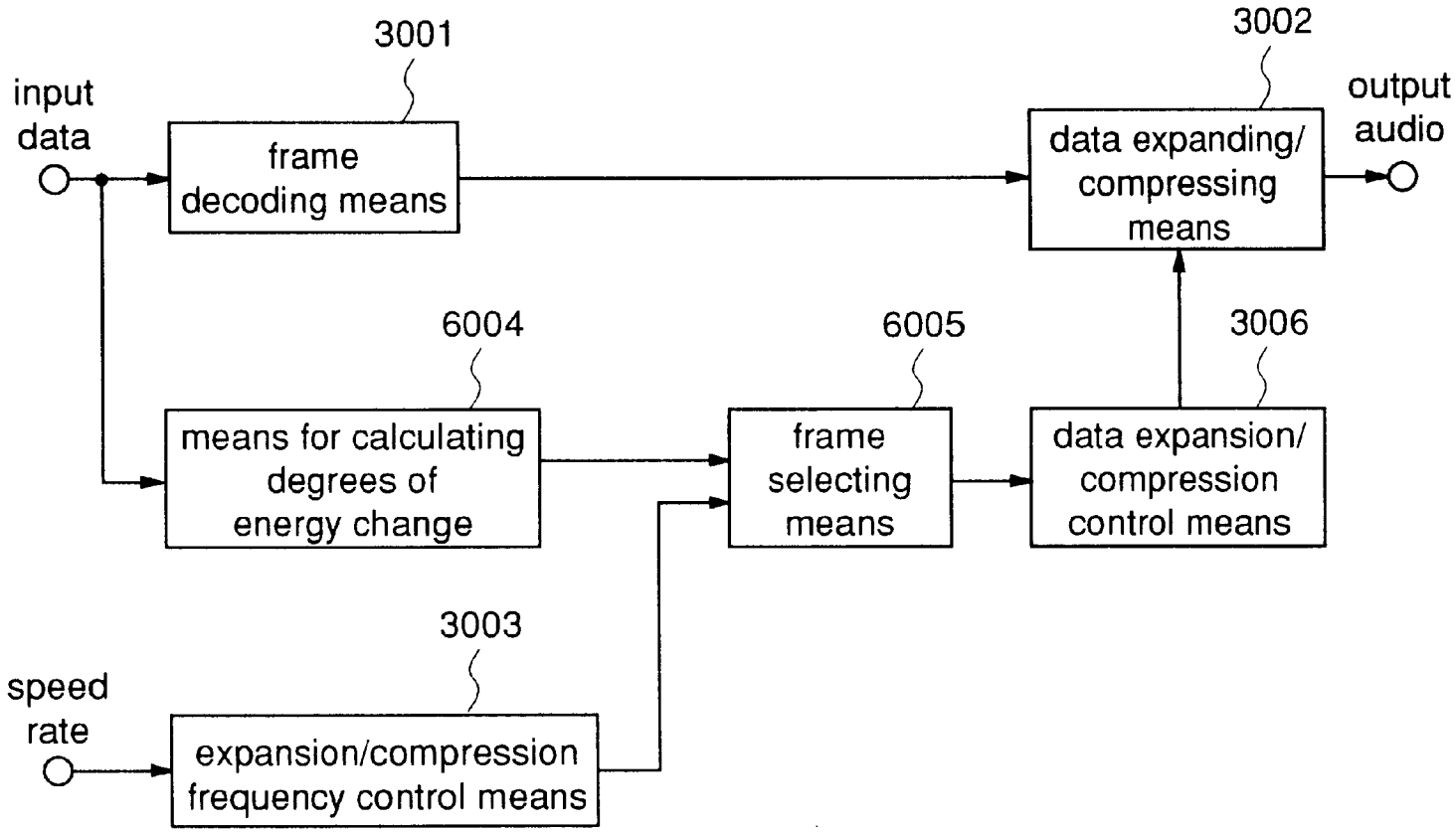
FIG. 12 is a block diagram showing an audio reproducing apparatus according to a sixth embodiment present invention.

A description is given of a sixth embodiment of the present invention with reference to figures. FIG. 12 is a block diagram showing an audio reproducing apparatus of the sixth embodiment of the present invention. In FIG. 12, reference numerals 3001, 3002, 3003, 6004, 6005, and 3006 designate frame decoding means, data expanding/compressing means, expansion/compression frequency control means, means for calculating degrees of energy change, frame selecting means, and data expansion/compression control means, respectively. Operation will be described below.

In the sixth embodiment, there is illustrated an audio reproducing apparatus which performs time-scale modification process to audio to be decoded frame by frame.

Referring to FIG. 12,the frame decoding means 3001, the data expanding/compressing means 3002, the expansion/compression frequency control means 3003, and the data expansion/compression control means 3006 operate as in the case of the third embodiment. In this embodiment, a description is in large part given of operation of the frame selecting means which selects frames to be expanded/compressed.

In this embodiment, "degrees of energy change in audio waveforms" are concerned. Energy values for plural small parts into which a frame is divided are found and difference values between these and previous values thereof are computed for respective parts to find degrees of energy change. This temporal degrees of energy change are continuously supervised and frames to be processed are selected, allowing for temporal masking, i.e., masking effects on parts which are temporarily contiguous. This masking is described in detail in "An Introduction to the Psychology of Hearing" by B. C. J. Moore, published by Academic Press limited. There occurs masking effects on parts before and after a masker. Utilizing this characteristic, distortion resulting from time-scale expansion/compression process is hardly detected. To be specific, a low-energy frame immediately after a high-energy frame is masked (backward masking) and distortion resulting from time-scale expansion/compression process is hardly detected. On the other hand, when there is a high-energy frame is present immediately after a low-energy frame, the low-energy frame is masked (forward masking), and distortion resulting from time-scale expansion/compression process is also hardly detected. Besides, amount of masking varies depending upon a level difference and a time difference with respect to the masker. Care must be taken lest another low energy portion should become difficult to hear due to another temporal masking effects resulting from time-scale compression at high-speed reproduction.

The means for calculating degrees of energy change 6004 finds degrees of energy change in the frame cycle number determined by the expansion/compression frequency control means 3003. Then, the frame selecting means 6005 selects a prescribed number "Ns" of frames with priority starting with a frame in which distortion is hardly detected because of masking effects, with reference to "Nf" values of degrees of energy change previously found. At this time, care must be taken lest audio in low-energy parts which have been subjected to time-scale compression should become difficult to hear. That is, since forward and backward masking effects on a low energy frame between large energy frames may increase due to shortened time length, another frame must be selected. The data expansion/compression control means 3006 decides whether or not the selected frames are frames to be expanded/compressed and controls expansion/compression of the data expanding/compressing means 3002. Input coded data is decoded by the frame decoding means 3001 frame by frame, and the frames to be expanded/compressed according to the decision by the control means 3006 are subjected to waveform expansion/compression, and the other frames are directly output. Thus, by the use of degrees of energy change found by the means for calculating degrees of energy change, optimum frames to be expanded/compressed in the frame cycle are selected by the frame selecting means. As a result, distortion of time-scale modified audio resulting from waveform expansion/compression is hardly detected.

While in the sixth embodiment temporal masking effects are employed using values for degrees of energy change in respective frames as an indicator, these may be replaced by degrees of change of averaged amplitudes obtained by computing averaged amplitude values for respective plural small parts into which a frame is divided, and computing difference values between these and previous values thereof for respective parts.

Embodiment 7

Figure 13:
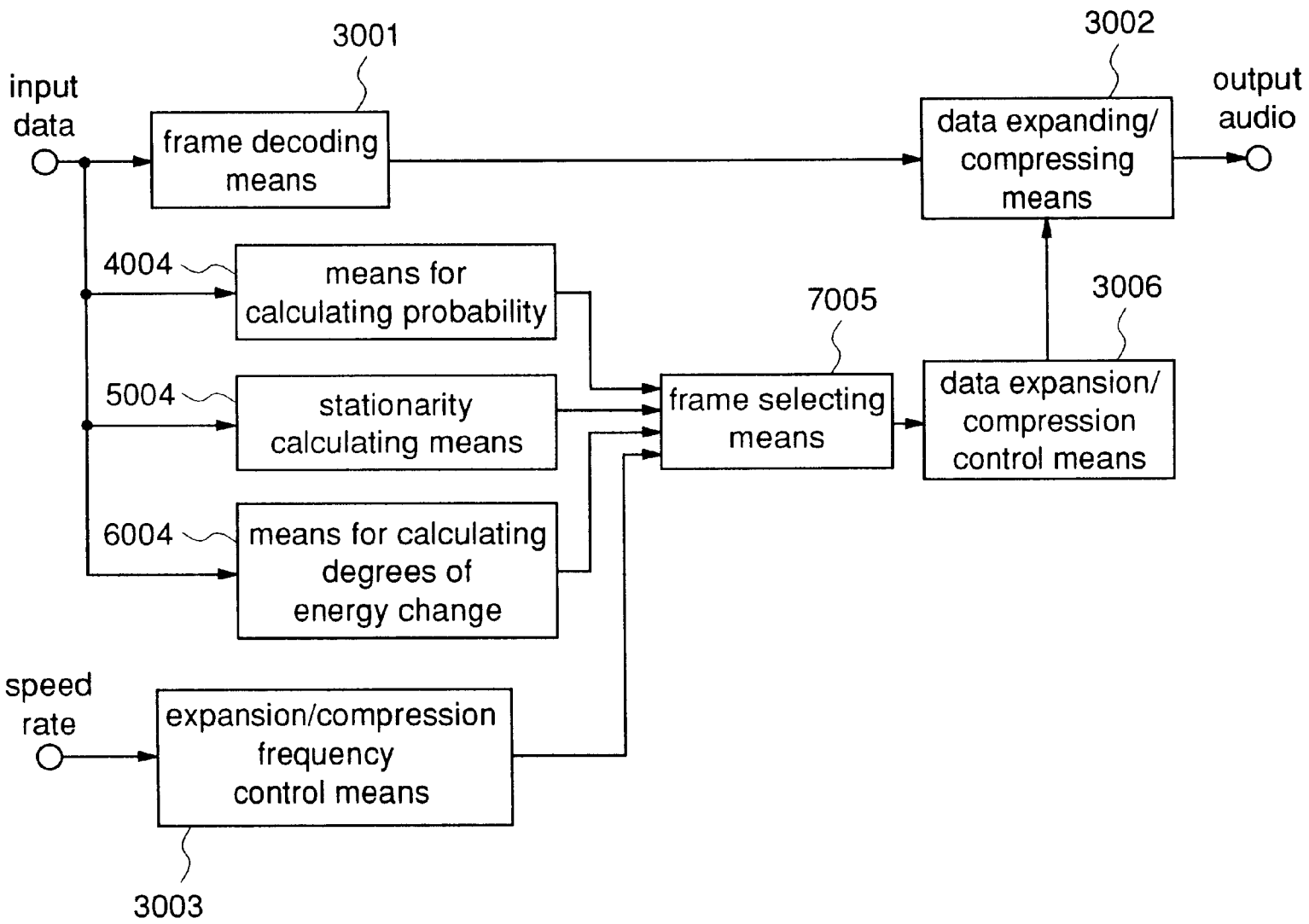
FIG. 13 is a block diagram showing an audio reproducing apparatus according to a seventh embodiment of the present invention.

A description is given of a seventh embodiment of the present invention with reference to figures. FIG. 13 is a block diagram showing an audio reproducing apparatus according to the seventh embodiment of the present invention. In FIG. 13, reference numerals 3001, 3002, 3003, 4004, 5004, 6004, 7005, and 3006 designate frame decoding means, data expanding/compressing means, expansion/compression frequency control means, means for calculating probabilities that frames contain audio signals, stationarity calculating means, means for calculating degrees of energy change, frame selecting means, and data expansion/compression control means, respectively. Operation will be described below.

In the seventh embodiment, there is illustrated an example of an audio reproducing apparatus which performs time-scale modification process to audio to be decoded frame by frame.

Referring to FIG. 13, the frame decoding means 3001, the data expanding/compressing means 3002, expansion/compression frequency control means 3003, and the data expansion/compression control means 3006 operate as in the case of the third embodiment. In addition, the calculating means 4004 operates as in the fourth embodiment, the stationarity calculating means 5004 operates as in the case of the fifth embodiment, and the means for calculating degrees of energy change 6004 operates as in the case of the sixth embodiment. In this embodiment, a description is in large part given of operation of the frame selecting means 7005 which selects frames to be expanded/compressed.

Assuming that information to be obtained from audio which has been subjected to time-scale modification process is audio and speech information, it is less desirable that processed audio becomes unintelligible to auditors. By academic publications, it has been proved that the time-scale modification process can improve intelligibility (see "Enhancing Speech Perception of Japanese Learners of English Utilizing Time-Scale Modification of Speech and Related Techniques" by K. Nakayama, K. Tomita-Nakayama, M. Misaki Speech Technology in Language Learning. KTH, 123–126, "Examination of Hearing Ability to High-Speed Word for Auxiliary Hearing Effects" by Hosoi, et. al, Audiology Japan vol.36. No. 5 pp.299–300 (1993)). For instance, for aged people whose time processing abilities to obtain audio have deteriorated, it is known that their intelligibility can be improved by reducing its speed. The seventh embodiment provides process for improving intelligibility by time-scale modification process and minimizing processing distortion, or process for obtaining audio information efficiently with no degradation of naturalness due to time-scale modification process. The frame selecting means 7005 numerizes analysis results of respective frames based on an output of the calculating means 4004, an output of the stationarity calculating means 5004, and masking conditions obtained by the means for calculating degrees of energy change 6004, and according to these, decides frames to-be-selected in which stress is laid on naturalness and frames to-be-selected in which stress is laid on intelligibility.

First, a description is given of a case where distortion of "naturalness" is minimized and audio is obtained efficiently. In this case, assume that priorities of frames in non-audio parts which are obtained by the means for calculating probabilities that frames contain audio signals are made higher. Taking the remaining two analysis results into account, frames to be selected are decided.

Next, a description is given of a case where "intelligibility" is improved and audio which is easy to hear is obtained. In this case, assume that priorities of parameters of degrees of energy change are made higher so that a head portion of a consonant with a low energy is not temporarily masked. Taking the remaining analysis results into account, frames to be selected are decided.

Thus, by the use of degrees of energy change found by the means for calculating degrees of energy change (or making priorities of the frames in the non-audio part obtained by the means for calculating probabilities higher), the frame selecting means finds optimum frames to be expanded/compressed in the frame cycle, whereby waveform expansion/compression of audio to be subjected to time-scale modification process is carried out taking priority of naturalness and intelligibility into account.

While in the seventh embodiment, the audio reproducing apparatus is provided with the means for calculating probabilities, stationarity calculating means, and the means for calculating degrees of energy change, the energy calculating means may be added thereto for decision to accurately estimate which frames are subjected to time-scale expansion/compression. The present invention offers plural choices of conditions for obtaining reproduced audio by using two or more of four calculating means for comprehensive estimation.

Embodiment 8

A description is given of an eighth embodiment of the present invention with reference to figures.

Prior to giving descriptions of eighth to eleventh embodiments, an MPEG1 audio layer 1/2 coding method will now be described.

Figure 26:
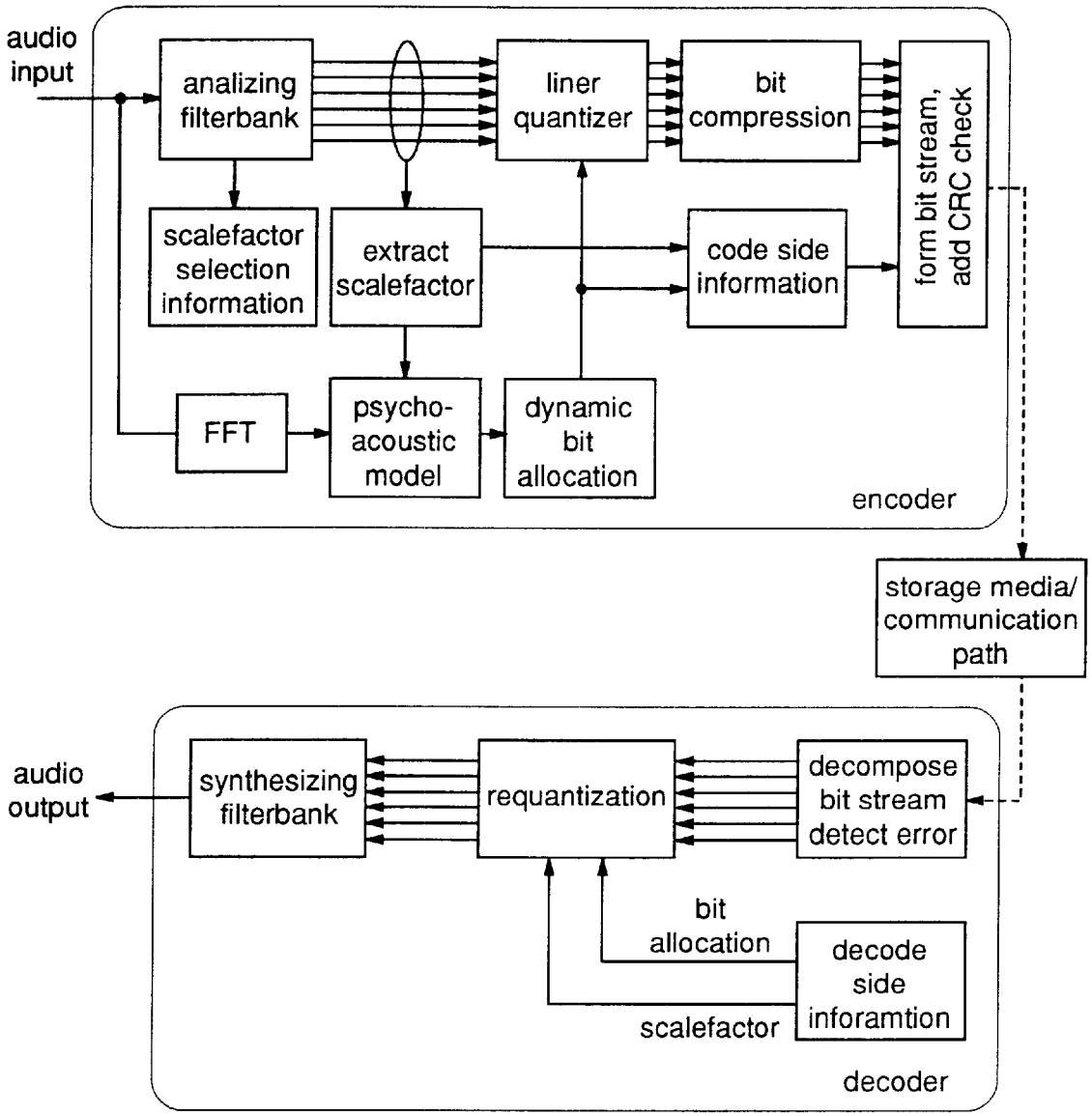
FIG. 26 is a block diagram showing a structure of an MPEG1 audio layer 2.

FIG. 26 is a block diagram showing the MPEG1 audio layer 1/2 coding method.

Referring now to FIG. 26, a 16-bit linearly quantized input signal is divided into subband signals of 32 subbands by a subband analyzing filterbank. The filterbank is implemented by a 512 tap PFB (Polyphase Filter Bank). Scalefactors of respective subband signals are computed, and dynamic ranges for them are prepared. These scalefactors are computed for each 12 samples in each subband of a layer 1, i.e., for each 384 samples as a whole, and for each 384 samples in a layer 2 on assumption that 1152 samples are a block. For this reason, resolution and coding quality are improved in the layer 2. However, the layer 2 has three times as many scalefactors as those of the layer 1, which causes a reduced compression ratio. As a solution to this, one value (scalefactor selection information) is allocated to combination of three scalefactors in the layer 2, whereby the reduced compression ratio is avoided.

Figure 14:
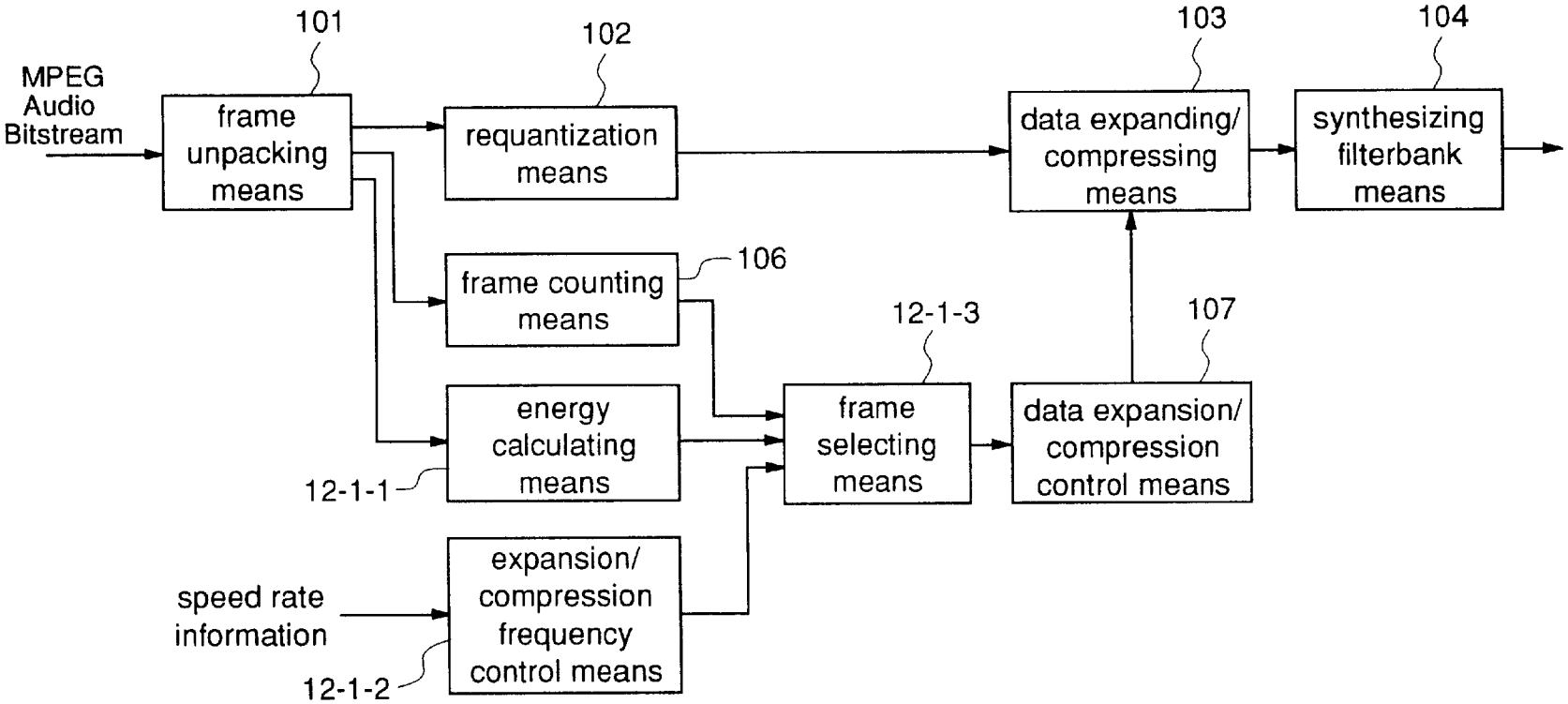
FIG. 14 is a block diagram showing an audio reproducing apparatus according to an eighth embodiment of the present invention.

FIG. 14 is a block diagram showing an audio reproducing apparatus according to the eighth embodiment of the present invention. In FIG. 14, reference numerals 101, 102, 103,

104, 106, 12-1-1, 12-1-2, 12-1-3, and 107 designate frame unpacking means, requantization means, data expanding/compressing means, synthesizing filterbank means, frame counting means, energy calculating means, expansion/compression frequency control means, frame selecting means, and data expansion/compression control means, respectively.

Figure 15:
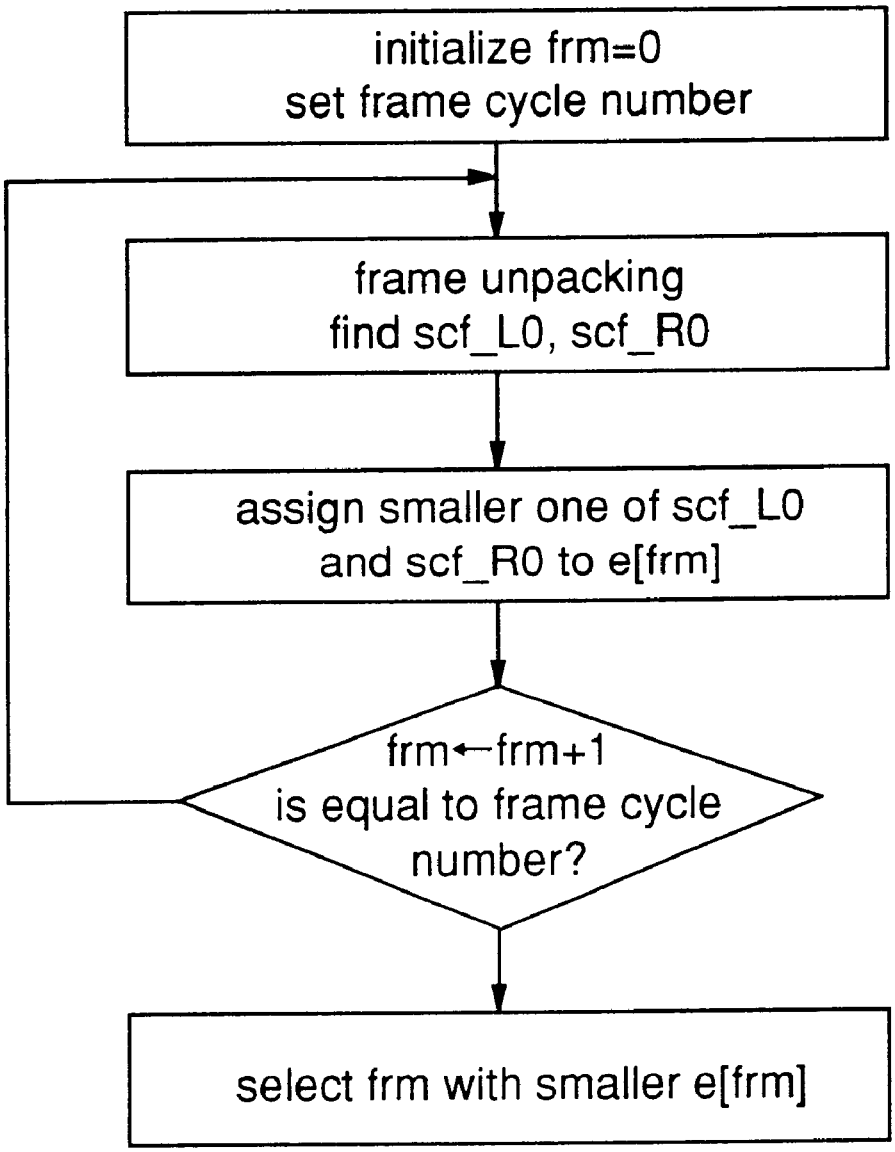
FIG. 15 is a flowchart showing a procedure for estimating energies of frames by energy calculating means 12-1-1 of the eighth embodiment.

FIG. 15 is a flowchart showing a process for estimating frame energies by the energy calculating means 12-1-1 of the eighth embodiment. Operation will be described below.

In the eighth embodiment, there is illustrated an audio reproducing apparatus which performs time-scale modification process to intermediate data of an MPEG1 audio layer 2 bit stream being decoded. The MPEG1 audio layer 2 bit stream comprises a header, bit allocation information, a scalefactor index, scalefactor selection information, sample data information, and so forth.

Referring to FIG. 14, from the input MPEG1 audio layer 2 bit stream, respective information such as the header, the bit allocation information, the scalefactor index, the scalefactor selection information, and the sample data information, are separated by the frame unpacking means 101.

The scalefactor index indicates a scalefactor at reproduction, and is present in each channel, in each effective subband, and in each block. The scalefactor index takes values in the range 0–62. When it takes "", the energy is the highest, and when it takes "62", the energy is the lowest. It should be noted that no scalefactor is present when a value for the bit allocation information is "0".

The bit allocation information has a value associated with the number of bits to be allocated at coding, and is present in each channel and in each effective subband.

Channels in the MPEG1 audio layer 2 are two channels, namely, right and left channels.

Subbands in the MPEG1 audio layer 2 are 32 subbands into which a band is divided, which are 0th, first, second, . . . , 31st subbands in ascending order of frequency.

In a case where a sampling frequency is 32 kHz, a 0–1600 Hz band is divided into 32 subbands, and therefore one subband has 500 Hz width. It should be remembered that the number of effective subbands is restricted. For instance, in case of 192 kbps stereo, it is assumed that 30 subbands (0th to 29th subbands) of 32 subbands (0th to 31st subbands) are effective, and therefore, there exist neither bit allocation information nor scalefactor indices in the 30th and 31st subbands.

In this case, a frequency band is 0–15000 Hz ($16000 \div 32 \times 30 = 15000$).

Blocks in the MPEG1 audio layer 2 are 3 temporal domains of the same size into which a frame is divided, which are 0th, first, and second blocks in a time sequence. When the sampling frequency is 32 kHz, one block length is 12 ms, and one frame length is 36 ms.

The energy calculating means 12-1-1 calculates an energy estimation value e[frm] for each frame number frm in a frame cycle, by the use of a scalefactor index scf_L0 of a left channel in a 0th subband of a 0th block and a scalefactor index scf_R0 of a right channel in the 0th subband of the 0th block. To be more detailed, a frame with a smaller scalefactor index has a higher energy, and the smaller of the scf_L0 and scf_R0 is used to calculate the energy estimation value e[frm].

Where there is only one of the scf_L0 and scf_R0, the energy calculating means 12-1-1 uses its value to calculate the energy estimation value e[frm].

Where there is neither scf_L0 nor scf_R0, the energy calculating means 12-1-1 assigns a prescribed value indicating that the corresponding frame is selected among candidates with the lowest priority to the energy estimation value e[frm].

The expansion/compression frequency control means 12-1-2 sets the frame cycle number and the number of frames to be expanded/compressed in the frame cycle according to a given speed rate. For instance, in case of 0.9 multiple speed, 2 of 9 frames are selected as frames to be subjected time-scale modification. In other words, the frame cycle number is 9, and the frame number frm varies from 0 to 8. The frame selecting means 12-1-3 selects frames to be expanded/compressed in ascending order of the energy estimation values e[frm] for respective frames in the frame cycle output from the energy calculating means 12-1-1. Selecting a frame with a smaller e[frm] with priority, subjects a portion of audio with a low energy to time-scale modification.

Alternatively, by the use of a minimum value of the scalefactor index scf_L0 of the left channel in the 0th subband of the 0th block, a scalefactor index scf_L1 of a left channel in a 0th subband of a first block, a scalefactor index scf_L2 of a left channel in a 0th subband of a second block, the scalefactor index scf_R0 of the right channel in the 0th subband of the 0th block, a scalefactor index scf_R1 of a right channel in the 0th subband of the first block, and a scalefactor index scf_R2 of a right channel in the 0th subband of the second block, the energy estimation value e[frm] may be computed.

Thus, in accordance with the eighth embodiment, the energy calculating means 12-1-1 estimates energies of audio signals based on values of scalefactor indices indicating scalefactors at reproduction, and selects frames to be subjected time-scale modification according to the results. Therefore, energy operation on PCM data after MPEG decoding becomes unnecessary, and for intermediate data of the MPEG1 audio layer 2 bit stream being decoded, frames are selected and subjected to time-scale modification. As a result, time-scale modification process can be implemented with less amount of operation.

Embodiment 9

A description is given of a ninth embodiment of the present invention with reference to figures.

Figure 16:
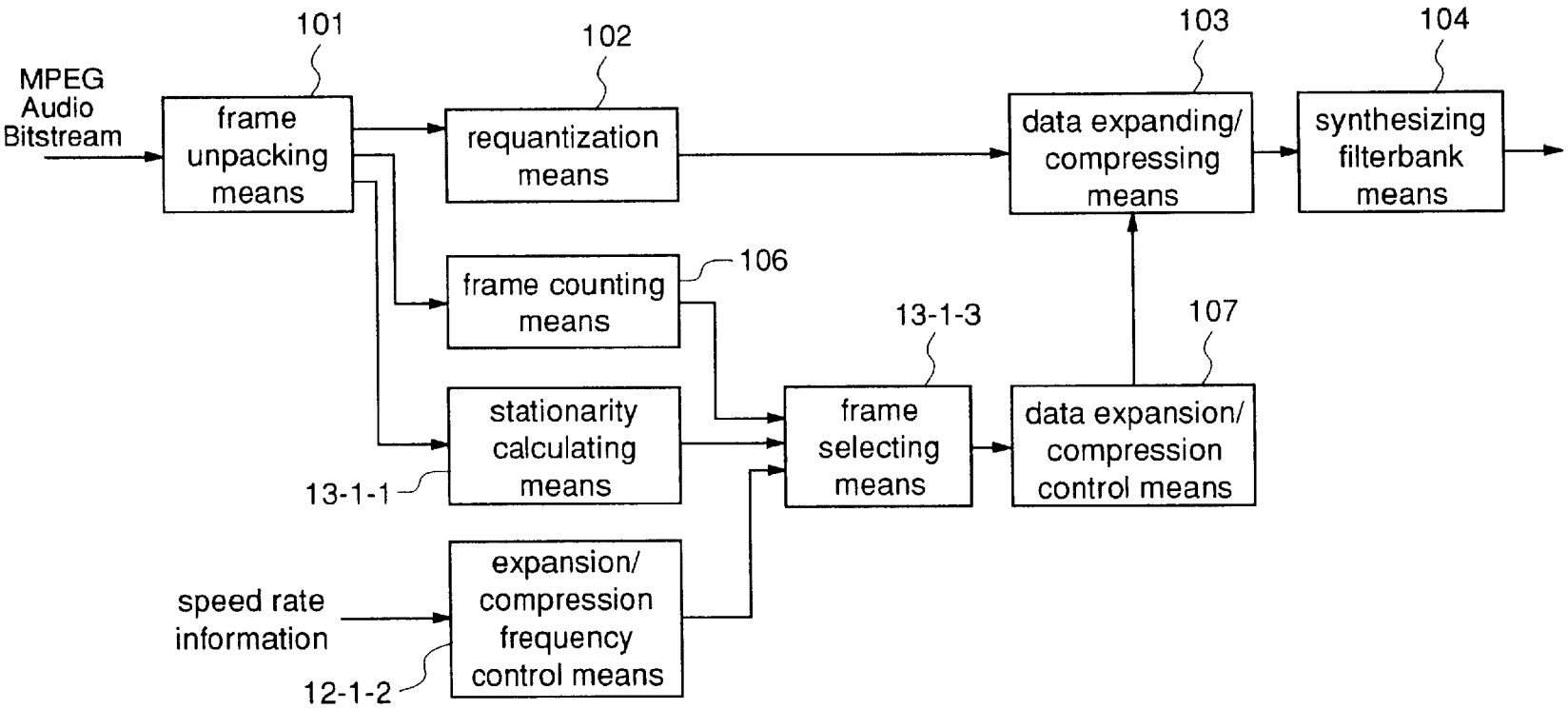
FIG. 16 is a block diagram showing an audio reproducing apparatus according to a ninth embodiment of the present invention.

FIG. 16 is a block diagram showing an audio reproducing apparatus according to the ninth embodiment of the present invention.

In the figure, reference numerals 101, 102, 103, 104, 106, 13-1-1, 12-1-2, 13-1-3, and 107 designate frame unpacking means, requantization means, data expanding/compressing means, synthesizing filterbank means, frame counting means, stationarity calculating means, expansion/compression frequency control means, frame selecting means, and data expansion/compression control means, respectively. Table 4 shows orders according to stationarity output from the stationarity calculating means 13-1-1, in accordance with which frames to be subjected to time-scale modification are selected. Operation will be described below.

TABLE 4

| Ord [frm] | scfsi L0 | scfsi R0 |
|---|---|---|
| 1 | 2 | 2 |
| 2 | 1 | 2 |
| 2 | 2 | 1 |
| 2 | 2 | 3 |
| 2 | 3 | 2 |
| 3 | 1 | 1 |
| 3 | 1 | 3 |
| 3 | 3 | 1 |
| 3 | 3 | 3 |
| 4 | 0 | 2 |
| 4 | 2 | 0 |
| 5 | 0 | 1 |
| 5 | 1 | 0 |
| 5 | 0 | 3 |
| 5 | 3 | 0 |
| 6 | 0 | 0 |

In the ninth embodiment, there is illustrated an audio reproducing apparatus which performs time-scale modification process to intermediate data of an MPEG1 audio layer 2 bit stream being decoded. The MPEG1 audio layer 2 bit stream comprises a header, bit allocation information, a scalefactor index, scalefactor selection information, sample data information, and so forth.

Referring to FIG. 16, from the input MPEG1 audio layer 2 bit stream, respective information such as the header, the bit allocation information, the scalefactor index, the scalefactor selection information, and the sample data information, are separated by the frame unpacking means 101. The scalefactor selection information indicates waveform stationarity and is present in each channel and in each effective subband. The scalefactor selection information can take values 0, 1, 2, and 3. Here it is assumed that the stationarity is the lowest when the information takes "0", the stationarity is the highest when the information takes "2", and the stationarities are the same when the information takes "1" and "3".

The stationarity calculating means 13-1-1 calculates orders ord [frm] of respective frame numbers frm in the frame cycle, in accordance with which frames are selected among candidates, by the use of scalefactor selection information scfsi_L0 of a left channel in a 0th subband and scalefactor selection information scfsi_R0 of a right channel in a 0th subband. The stationarity calculating means 13-1-1 finds ord [frm] for respective frames in the frame cycle, following a rule shown in table 4. Where one of the scfsi_L0 and scfsi_R0 is not present, or neither the scfsi_L0 nor scfsi_R0 is present, the calculating means 13-1-1 assigns a prescribed value indicating that the corresponding frame is selected among candidates with the lowest priority to the order ord [frm].

The expansion/compression frequency control means 12-1-2 sets the frame cycle number and the number of frames to be expanded/compressed in the frame cycle. The frame selecting means 13-1-3 selects frames to be expanded/compressed in descending order of the orders ord [fr] for respective frames in the frame cycle output from the stationarity calculating means 13-1-1.

Thus, in accordance with the ninth embodiment, the stationarity calculating means 13-1-1 estimates stationarities of audio signals based on values of scalefactor selection information indicating waveform stationarities. Therefore, stationarity operation on PCM data after MPEG decoding becomes unnecessary. As a result, time-scale modification process can be implemented with less amount of operation.

The ninth embodiment is thus characterized in that frames with high stationarities whose audio qualities are hardly degraded due to time-scale modification are selected and subjected to time-scale modification, and is thus capable of performing time-scale modification of speech. Therefore, this is well suited to linguistic learning. Besides, since stationarity operation is unnecessary, amount of operation can be reduced.

Embodiment 10

Figure 17:
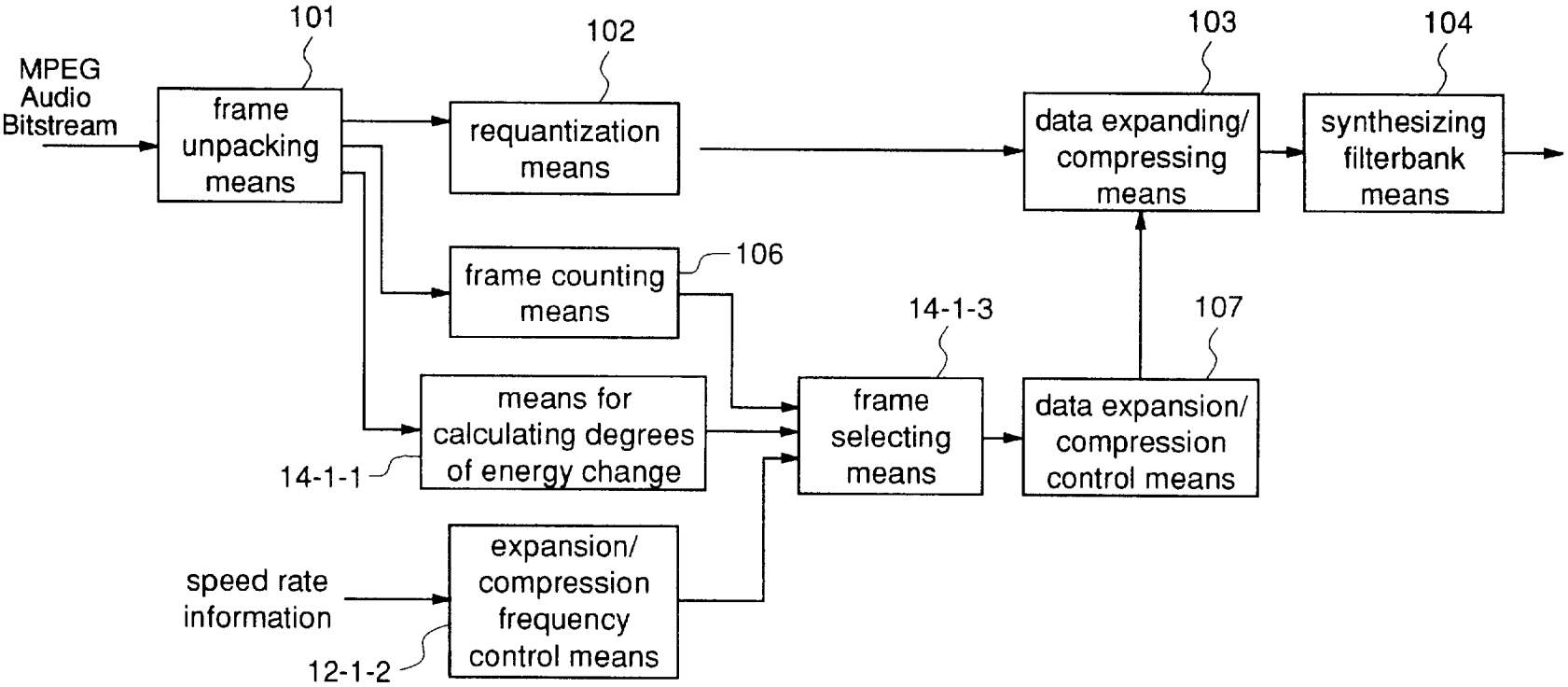
FIG. 17 is a block diagram showing an audio reproducing apparatus according to a tenth embodiment of the present invention.

A description is given of a tenth embodiment of the present invention with reference to figures. FIG. 17 is a block diagram showing an audio reproducing apparatus according to the tenth embodiment of the present invention.

In the figure, reference numerals 101, 102, 103, 104, 106, 14-1-1, 12-1-2, 14-1-3, and 107 designate frame unpacking means, requantization means, data expanding/compressing means, synthesizing filterbank means, frame counting means, means for calculating degrees of energy change, expansion/compression frequency control means, frame selecting means, and data expansion/compression control means, respectively. Operation will be described below.

In the tenth embodiment, there is illustrated an audio reproducing apparatus which performs time-scale modification process to intermediate data of an MPEG1 audio layer 2 bit stream being decoded. The MPEG1 audio layer 2 bit stream comprises a header, bit allocation information, a scalefactor index, scalefactor selection information, sample data information, and so forth.

Referring to FIG. 17, from the input MPEG1 audio layer 2 bit stream, respective information such as the header, the bit allocation information, the scalefactor index, the scalefactor selection information, and the sample data information, are separated by the frame unpacking means 101. The means for calculating degrees of energy change 14-1-1, finds an energy estimation value e[ch] [blk] [frm] of each channel of each block for each frame number frm, by the use of a scalefactor index scf_L0 of a left channel in a 0th subband of a 0th block, a scalefactor index scf_L1 of a left channel in a 0th subband of a first block, a scalefactor index scf_L2 of a left channel in a 0th subband of a second block, a scalefactor index scf_R0 of a right channel in the 0th subband of the 0th block, a scalefactor index scf_R1 of a right channel in a 0th subband of the first block, and a scalefactor index scf_R2 of a right channel in the 0th subband of the second block. For instance, when the frame cycle number is "9", frames in the frame cycle and one frame before and one frame after the frame cycle are, 9 frames plus one frame before and one frame after the 9 frames, i.e., 11 frames.

To be specific, an energy estimation value e[ch] [blk] [frm] of each channel of each block for each frame number, corresponding to the scalefactor index of each channel in the 0th subband of each block is found for each of frames in the frame cycle and one frame before and one frame after the frame cycle. The smaller scalefactor index a block has, the higher energy it has.

When there is no scalefactor index, the energy is "0". To be more detailed, in case of a frame which has no scf_L0, e[0] [0] [frm]=0, in case of a frame which has no scf_L1, e[0] [1] [frm]=0, in case of a frame which has no scf_L2, e[0] [2] [frm]=0, in case of a frame which has no scf_R0, e[1] [0] [frm]=0, in case of a frame which has no scf_R1, e[1] [1] [frm]=0, and in case of a frame which has no scf_R2, e[1] [2] [frm]=0.

Subsequently, a maximum value emax[ch] [frm] in the block of energy estimation values e[ch] [blk] [frm] for respective frame numbers frm in the frame cycle is found for all the frame cycles. It is not necessary to find a value emax[ch][frm] for one frame before and one frame after the frame cycle.

Then, for each frame number frm in the frame cycle, 4 values, i.e., an energy estimation value e[0] [2] [frm−1]−emax[0] [frm], an energy estimation value e[1] [2] [frm−1]−emax[1] [frm], an energy estimation value e[0] [0] [frm+1]−emax[0] [frm], and an energy estimation value e[1] [0] [frm+1]−emax[1] [frm], are computed and a maximum value for these 4 values is assigned to the priority p[frm] in accordance with which frames are selected among candidates.

The expansion/compression frequency control means 12-1-2 sets the frame cycle number and the number of frames to be expanded/compressed in the frame cycle according to a given speed rate. The frame selecting means 14-1-3 selects frames to be expanded/compressed in descending order of the priorities p[frm] of frames in the frame cycle output from the means for calculating degrees of energy change 14-1-1. A frame with a higher priority p[frm] is easier to mask by non-simultaneous masking, and therefore, degradation of its audio quality resulting from time-scale modification is difficult to percept. The non-simultaneous masking is described in detail in "An Introduction to the Psychology of Hearing" by B. C. J. Moore, published by Academic Press Limited.

Thus, in accordance with the tenth embodiment, the means for calculating degrees of energy change 14-1-1 estimates degrees of energy change in audio signals based on values of scalefactor indices indicating scalefactors at reproduction, and frames with higher priorities p[frm] are subjected to time-scale modification. Therefore, degrees of energy change operation on PCM data after MPEG decoding becomes unnecessary. As a result, time-scale modification process can be implemented with less amount of operation. Besides, this method allows speech time-scale modification, and therefore is well suited to linguistic learning.

Embodiment 11

A description is given of an eleventh embodiment of the present invention with reference to figures.

Figure 18:
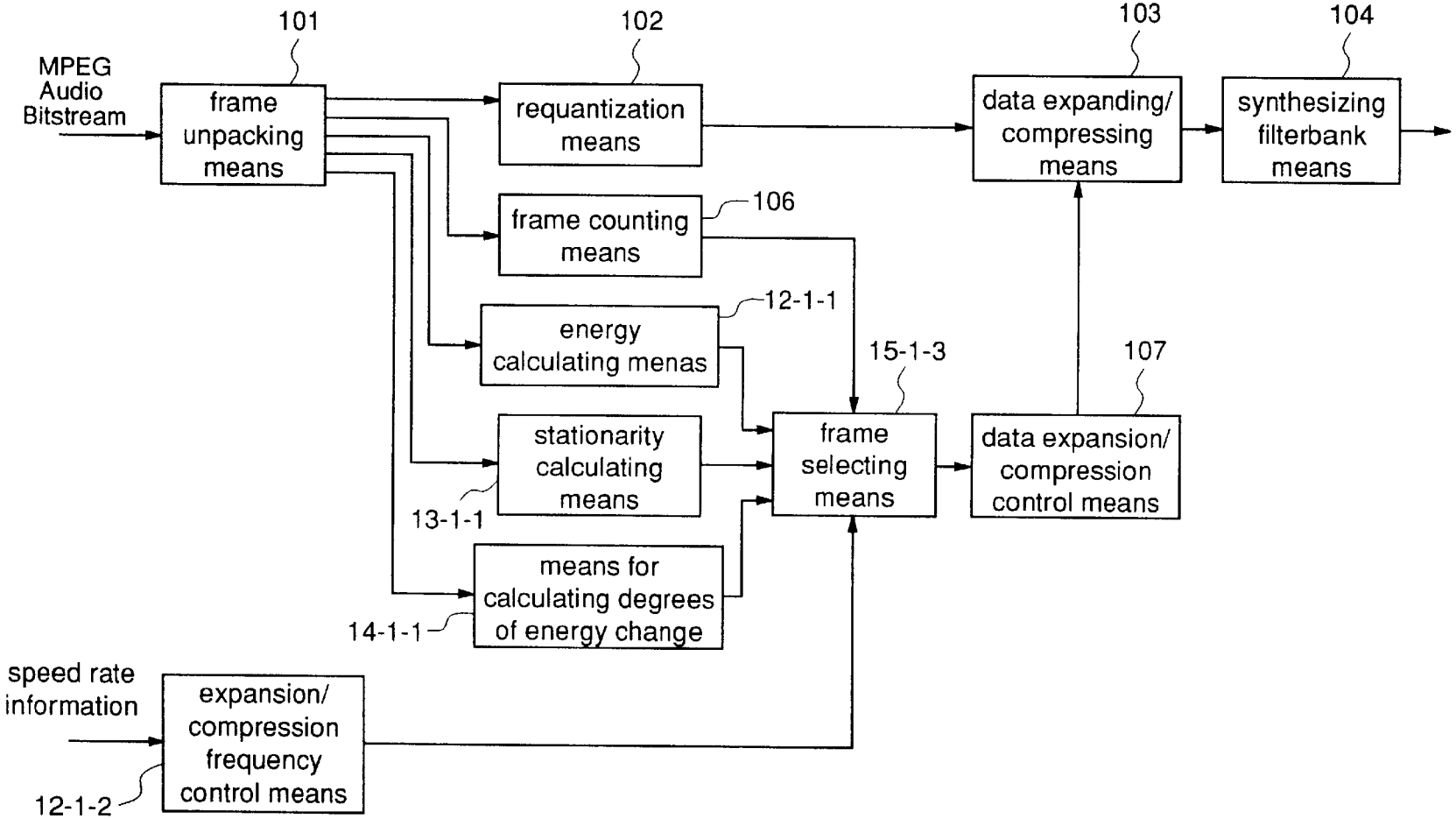
FIG. 18 is a block diagram showing an audio reproducing apparatus according to a tenth embodiment of the present invention.
Figure 19:
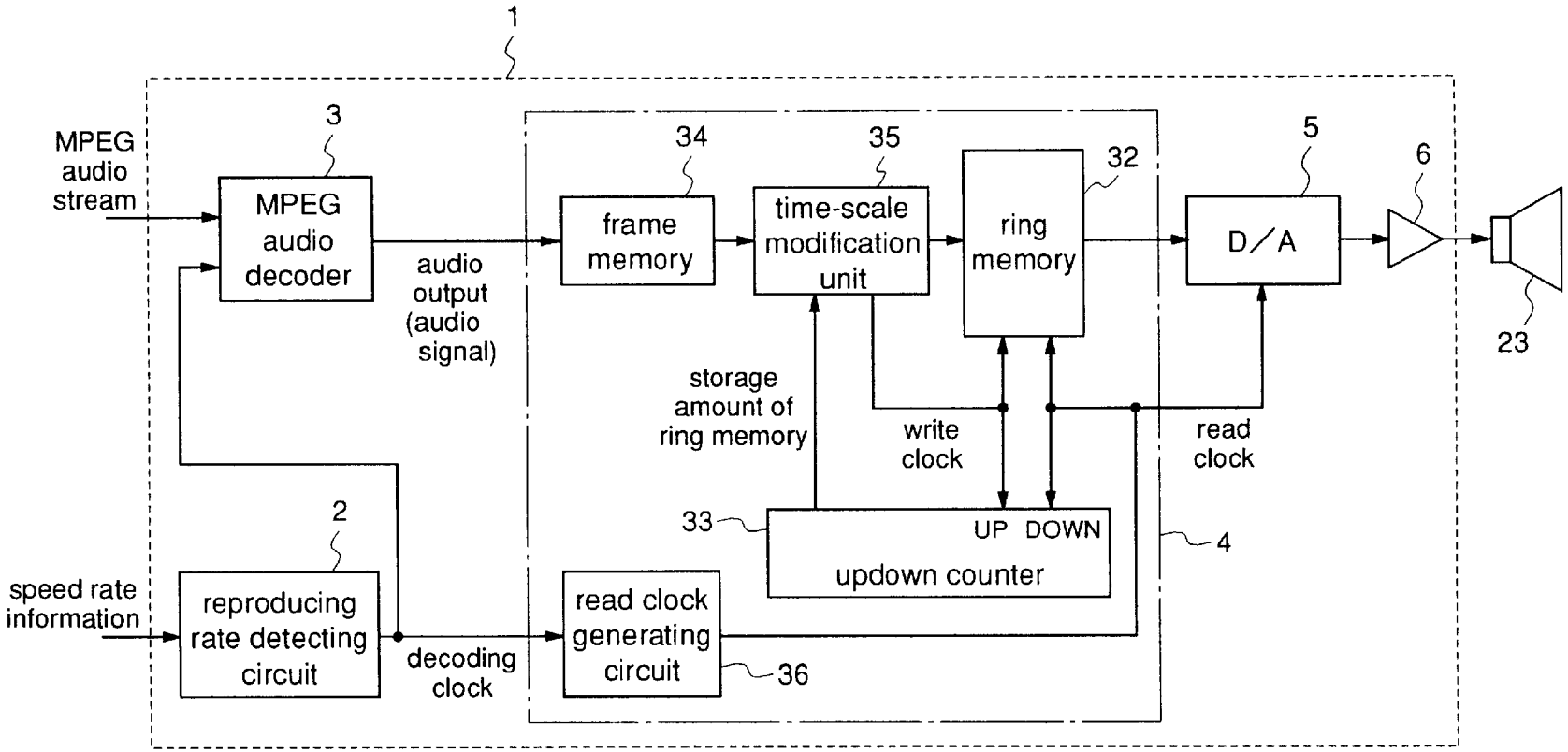
Fig.19 Prior Art
FIG. 19 is a block diagram showing a prior art audio reproducing apparatus.
Figure 20:
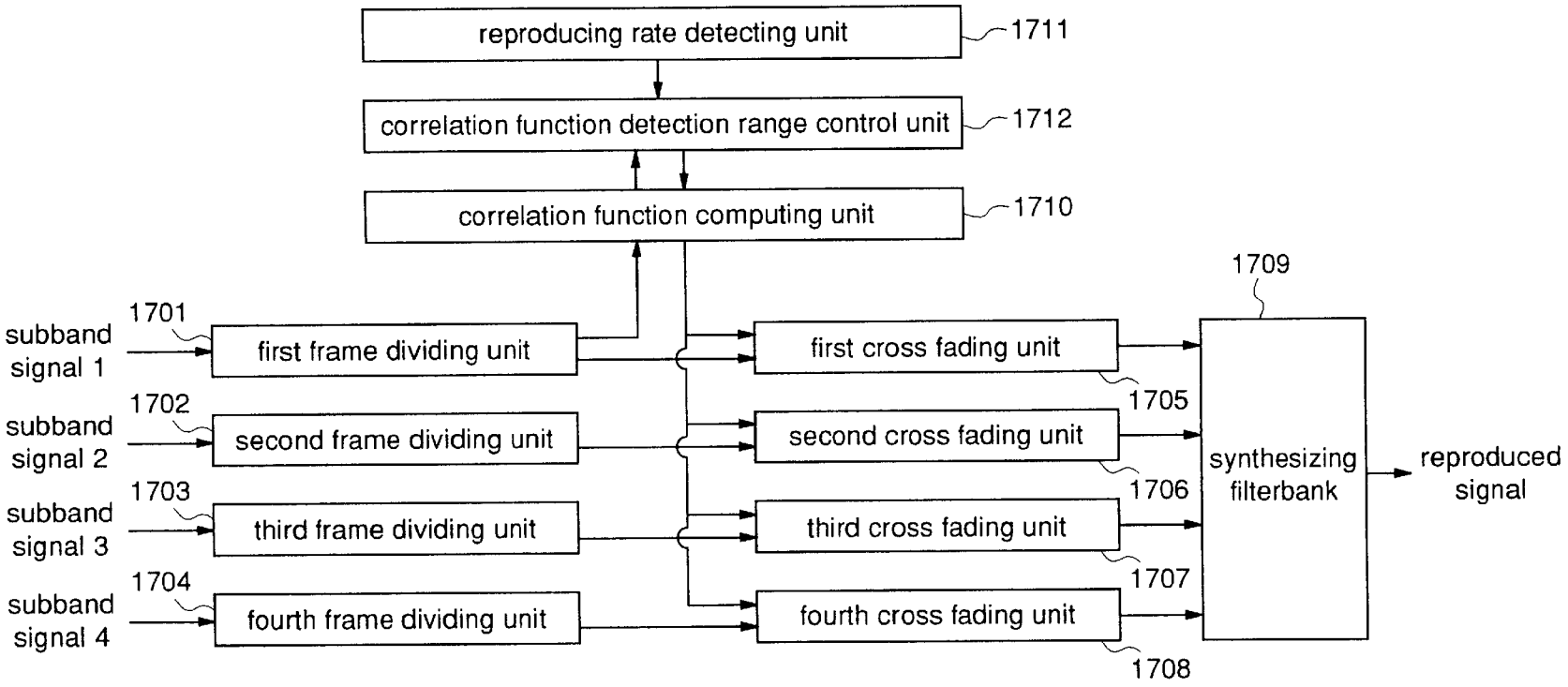
Fig.20 Prior Art
FIG. 20 is a block diagram showing another prior art audio reproducing apparatus.
Figure 21:
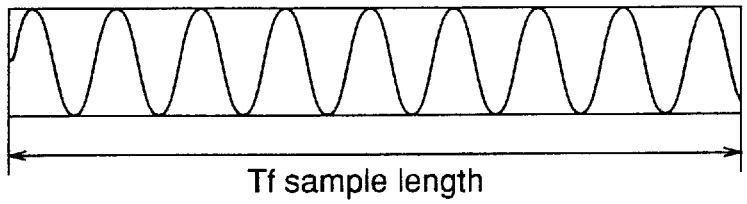
FIG. 21 is a diagram showing time-scale waveform of one frame of a frequency band which contains main pitch components of an audio signal.
Figure 22:
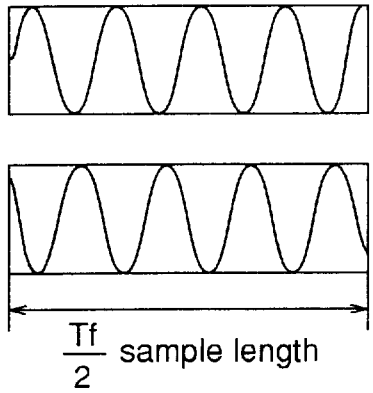
FIG. 22 is a diagram showing a case where one frame signal in FIG. 21 is divided into two segments of a first half signal part and a second half signal part, which are disposed as upper and lower parts.
Figure 23:
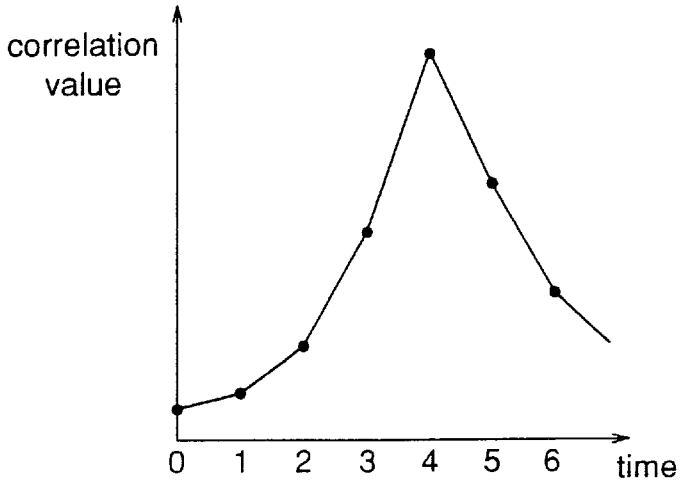
FIG. 23 is a graph showing values of a correlation function for two segments in FIG. 22.

FIG. 18 is a block diagram showing an audio reproducing apparatus according to the eleventh embodiment of the present invention.

In the figure, reference numerals 101, 102, 103, 104, 106, 12-1-1, 13-1-1, 14-1-1, 12-1-2, 15-1-3, and 107 designate frame unpacking means, requantization means, data expanding/compressing means, synthesizing filterbank means, frame counting means, energy calculating means, stationarity calculating means, means for calculating degrees of energy change, expansion/compression frequency control means, frame selecting means, and data expansion/compression control means, respectively. Operation will be described below.

In the eleventh embodiment, there is illustrated an example of an audio reproducing apparatus which performs time-scale modification process to intermediate data of an MPEG1 audio layer 2 bit stream being decoded. The MPEG1 audio layer 2 bit stream comprises a header, bit allocation information, a scalefactor index, scalefactor selection information, sample data information, and so forth.

Referring to FIG. 18, from the input MPEG1 audio layer 2 bit stream, respective information such as the header, the bit allocation information, the scalefactor index, the scalefactor selection information, and the sample data information, are separated by the frame unpacking means 101.

The energy calculating means 12-1-1 finds energy estimation values e[frm] for respective frame numbers frm in a frame cycle as already described in the eighth embodiment.

The stationarity calculating means 13-1-1 finds orders ord[frm] for respective frame numbers frm in the frame cycle, in accordance with which frames are selected among candidates, as already described in the ninth embodiment.

The means for calculating degrees of energy change 14-1-1 finds priorities p[frm] for respective frame numbers in the frame cycle, in accordance with which frames are selected among candidates, as already described in the tenth embodiment.

The expansion/compression frequency control means 12-1-2 sets the frame cycle number and the number of frames to be expanded/compressed in the frame cycle according to a given speed rate. In order to reduce degradation of naturalness and obtain audio efficiently, the frame selecting means 15-1-3 selects frames to be expanded/compressed in ascending order of energy estimation values e[frm] for respective frames in the frame cycle output from the energy calculating means 12-1-1. In order to improve intelligibility and obtain audio which is easy to hear, the frame selecting means 15-1-3 selects frames to be expanded/compressed in descending order of the orders ord[frm] for respective frames in the frame cycle output from the stationarity calculating means 13-1-1. In this case, when values for the orders ord[frm] are equal, according to the priorities p[frm] output from the means for calculating degrees of energy change 14-1-1, frames with higher p[frm] are selected, to decide another priorities for the frames which have the same value for the orders ord[frm].

Thus, in accordance with the eleventh embodiment, the energy calculating means 12-1-1, the stationarity calculating means 13-1-1, and the means for calculating degrees of energy change 14-1-1 estimate energies, stationarities, and degrees of energy change of the audio signals, respectively, based on scalefactor indices indicating scalefactors at reproduction and values for scalefactor selection information, and frames with smaller e[frm] are selected for naturalness and frames with higher ord [frm] are selected for intelligibility, and when values for the ord[frm] are equal, frames with higher p[frm] are selected. Therefore, operation of energies, stationarities, and degrees of energy change on PCM data after MPEG decoding becomes unnecessary. As a result, time-scale modification process can be implemented with less amount of operation.

It should be noted that the means for calculating probabilities 4004 of the fourth embodiment is not discussed in description of the eleventh embodiment because the MPEG1 audio layer 2 bit stream contains no information indicating probabilities that frames contain audio signals.

What is claimed is:

1. An audio reproducing apparatus comprising:

audio decoding means for decoding an input audio signal frame by frame;

data expanding/compressing means for subjecting data in a decoded frame to time-scale modification process;

a frame sequence table which contains a sequence determined according to a given speed rate in which respective frames are to be expanded/compressed;

frame counting means for counting the number of frames of the input audio signal; and data expansion/compression control means for instructing the data expanding/compressing means to subject the frame to one of time-scale compression process, time-scale expansion process, and process without time-scale modification process, with reference to the frame sequence table based on a count value output from the frame counting means, the data expanding/compressing means subjecting the audio signal to time-scale modification process in accordance with an instruction signal from the data expansion/compression control means.

2. The audio reproducing apparatus of claim 1 wherein the data expanding/compressing means includes cross fading means for dividing each frame of the input audio signal into at least two segments and performing weighting addition to waveform data of each segment.

3. The audio reproducing apparatus of claim 2 wherein the data expanding/compressing means subjects a frame to time-scale compression/expansion process in a prescribed ratio, and the data expansion/compression control means controls frequency at which frames to be subjected to time-scale compression/expansion process and frames to be output without time-scale modification process appear, to reproduce audio at the given speed rate.

4. The audio reproducing apparatus of claim 2 wherein the frame sequence table includes plural sequence tables having different patterns per one speed rate, the data expanding/compressing means finds an average of correlation values between segments in respective frames to be expanded/compressed for each sequence table, and performs processing with reference to a sequence table in which the average is the largest.

5. The audio reproducing apparatus of claim 1 wherein the data expanding/compressing means subjects a frame to time-scale compression/expansion process in a prescribed ratio, and the data expansion/compression control means controls frequency at which frames to be subjected to time-scale compression/expansion process and frames to be output without time-scale modification process appear, to reproduce audio at the given speed rate.

6. The audio reproducing apparatus of claim 5 wherein the data expanding/compressing means subjects the frame to time-scale compression/expansion process in a prescribed ratio, and the frame sequence table contains the sequence in which frames to be subjected to time-scale compression/expansion process in the frame cycle in which a time-scale compression/expansion sequence is repeated are disposed as uniformly as possible, to reproduce audio at the given speed rate.

7. The audio reproducing apparatus of claim 6 wherein the audio decoding means for performing decoding frame by frame divides an audio signal into plural subband signals and performs decoding for each of divided subbands.

8. The audio reproducing apparatus of claim 6 wherein the audio decoding means for performing decoding frame by frame decodes data coded by an MPEG1 audio layer 2 coding method.

9. The audio reproducing apparatus of claim 6 wherein the data expanding/compressing means includes correlation calculating means for calculating correlation between segments of a frame and a position at which the correlation is high, and sending shift amount by which waveform data of a segment is shifted to the position, the cross fading means shifts the waveform data of the segment according to the shift amount, and performs weighting addition to each segment data, and for a subsequent frame to be subjected to time-scale compression/expansion, segment data is shifted and subjected to weighting addition, considering the shift amount of a frame which has been previously subjected to time-scale compression/expansion.

10. The audio reproducing apparatus of claim 9 wherein the audio decoding means for performing decoding frame by frame divides an audio signal into plural subband signals and performs decoding for each of the divided subbands, the correlation calculating means calculates a correlation value for each subband, and weighting addition is performed by using the shift amount of a subband which has the largest correlation value.

11. The audio reproducing apparatus of claim 9 wherein the audio decoding means for performing decoding frame by frame divides an audio signal into plural subband signals and performs decoding for each of the divided subbands, and the correlation calculating means calculates a correlation value for a subband of the divided subbands which has the highest averaged energy.

12. The audio reproducing apparatus of claim 6 wherein the data expanding/compressing means includes correlation calculating means for finding correlation between segments in each frame, the audio decoding means for performing decoding frame by frame divides an audio signal into plural subband signals and performs decoding for each of the divided subbands, and the correlation calculating means finds correlation between the segments by the use of data of a subband which contains pitch frequency of an audio signal.

13. The audio reproducing apparatus of claim 3 wherein the frame sequence table includes plural sequence tables having different patterns per one speed rate, the data expanding/compressing means finds an average of correlation values between segments in respective frames to be expanded/compressed for each sequence table, and performs processing with reference to a sequence table in which the average is the largest.

14. The audio reproducing apparatus of claim 5 wherein the frame sequence table includes plural sequence tables having different patterns per one speed rate, the data expanding/compressing means finds an average of correlation values between segments in respective frames to be expanded/compressed for each sequence table, and performs processing with reference to a sequence table in which the average is the largest.

15. The audio reproducing apparatus of claim 1 wherein the audio decoding means for performing decoding frame by frame divides an audio signal into plural subband signals and performs decoding for each of divided subbands.

16. The audio reproducing apparatus of claim 1 wherein the audio decoding means for performing decoding frame by frame decodes data coded by an MPEG1 audio layer 2 coding method.

17. The audio reproducing apparatus of claim 1 wherein the data expanding/compressing means includes correlation calculating means for calculating correlation between segments of a frame and a position at which the correlation is high, and sending shift amount by which waveform data of a segment is shifted to the position, the cross fading means shifts the waveform data of the segment according to the shift amount, and performs weighting addition to each segment data, and for a subsequent frame to be subjected to time-scale compression/expansion, segment data is shifted and subjected to weighting addition, considering the shift amount of a frame which has been previously subjected to time-scale compression/expansion.

18. The audio reproducing apparatus of claim 17 wherein the audio decoding means for performing decoding frame by frame divides an audio signal into plural subband signals and performs decoding for each of the divided subbands, the correlation calculating means calculates a correlation value for each subband, and weighting addition is performed by using the shift amount of a subband which has the largest correlation value.

19. The audio reproducing apparatus of claim 18 wherein the frame sequence table includes plural sequence tables having different patterns per one speed rate, the data expanding/compressing means finds an average of correlation values between segments in respective frames to be expanded/compressed for each sequence table, and performs processing with reference to a sequence table in which the average is the largest.

20. The audio reproducing apparatus of claim 17 wherein the audio decoding means for performing decoding frame by frame divides an audio signal into plural subband signals and performs decoding for each of the divided subbands, and the correlation calculating means calculates a correlation value of a subband of the divided subbands which has the highest averaged energy.

21. The audio reproducing apparatus of claim 20 the frame sequence table includes plural sequence tables having different patterns per one speed rate, the data expanding/compressing means finds an average of correlation values between segments in respective frames to be expanded/compressed for each sequence table, and performs processing with reference to a sequence table in which the average is the largest.

22. The audio reproducing apparatus of claim 17 wherein the frame sequence table includes plural sequence tables having different patterns per one speed rate, the data expanding/compressing means finds an average of correlation values between segments in respective frames to be expanded/compressed for each sequence table, and performs processing with reference to a sequence table in which the average is the largest.

23. The audio reproducing apparatus of claim 1 wherein the data expanding/compressing means includes correlation calculating means for finding correlation between segments in each frame;

the audio decoding means for performing decoding frame by frame divides an audio signal into plural subband signals and performs decoding for each of divided subbands, and the correlation calculating means finds correlation between the segments by the use of data of a subband which contains pitch frequency of an audio signal.

24. The audio reproducing apparatus of claim 23 wherein the frame sequence table includes plural sequence tables having different patterns per one speed rate, the data expanding/compressing means finds an average of correlation values between segments in respective frames to be expanded/compressed for each sequence table, and performs processing with reference to a sequence table in which the average is the largest.

25. The audio reproducing apparatus of claim 1 wherein the frame sequence table includes plural sequence tables having different patterns per one speed rate, the data expanding/compressing means finds an average of correlation values between segments in respective frames to be expanded/compressed for each sequence table, and performs processing with reference to a sequence table in which the average is the largest.

26. An audio reproducing apparatus comprising:

audio decoding means for decoding an input audio signal frame by frame;

data expanding/compressing means for subjecting data in a decoded frame to time-scale modification process;

expansion/compression frequency control means for setting a frame cycle number and the number of frames to be expanded/compressed in the frame cycle, according to a given speed rate;

energy calculating means for calculating energies of audio signals in respective frames;

frame selecting means for selecting frames to be expanded/compressed according to an output of the energy calculating means and an output of the expansion/compression frequency control means; and data expansion/compression control means for instructing the data expanding/compressing means to subject the frame to one of time-scale compression process, time-scale expansion process, and process without time-scale modification process, the frame selecting means selecting low-energy frames with priority.

27. The audio reproducing apparatus of claim 26 wherein the audio decoding means for performing decoding frame by frame divides an audio signal into plural subband signals and performs decoding for each of divided subbands.

28. The audio reproducing apparatus of claim 26 wherein the audio decoding means for performing decoding frame by frame decodes data coded by an MPEG1 audio layer 2 coding method.

29. The audio reproducing apparatus of claim 26 wherein the audio decoding means for performing decoding frame by frame decodes data coded by an MPEG1 audio layer 2 coding method, and the energy calculating means estimates an energy, of an audio signal based on a scalefactor index indicating a scalefactor at reproduction.

30. The audio reproducing apparatus of claim 26 wherein the data expanding/compressing means includes correlation calculating means for calculating correlation between segments of a frame and a position at which the correlation is high, and sending shift amount by which waveform data of a segment is shifted to the position, the cross fading means shifts the waveform data of the. segment according to the shift amount, and performs weighting addition to each segment data, and for a subsequent frame to be subjected to time-scale compression/expansion process, segment data is shifted and subjected to weighting addition, considering the shift amount of a frame which has been previously subjected to time-scale compression/expansion process.

31. The audio reproducing apparatus of claim 30 wherein the audio decoding means for performing decoding frame by frame divides an audio signal into plural subband signals and performs decoding for each of the divided subbands, the correlation calculating means calculates a correlation value for each subband, and weighting addition is performed by using the shift amount of a subband which has the largest correlation value.

32. The audio reproducing apparatus of claim 30 wherein the audio decoding means for performing decoding frame by frame divides an audio signal into plural subband signals and performs decoding for each of the divided subbands, and the correlation calculating means calculates a correlation value for a subband of the divided subbands which has the highest averaged energy.

33. The audio reproducing apparatus of claim 26 wherein the data expanding/compressing means includes correlation calculating means for finding correlation between segments in each frame, the audio decoding means for performing decoding frame by frame divides an audio signal into plural subband signals and performs decoding for each of the divided subbands, and the correlation calculating means finds correlation between the segments by the use of data of a subband which contains pitch frequency of an audio signal.

34. An audio reproducing apparatus comprising:

audio decoding means for decoding an input audio signal frame by frame;

data expanding/compressing means for subjecting data in a decoded frame to time-scale modification process;

expansion/compression frequency control means for setting a frame cycle number and the number of frames to be expanded/compressed in the frame cycle, according to a given speed rate;

means for calculating probabilities that respective frames contain humane voice;

frame selecting means for selecting frames to be expanded/compressed according to an output of the means for calculating probabilities and an output of the expansion/compression frequency control means; and data expansion/compression control means for instructing the data expanding/compressing means to subject the frame to one of time-scale compression process, time-scale expansion process, and process without time-scale modification process, the frame selecting means selecting low-probability frames with priority.

35. The audio reproducing apparatus of claim 34 wherein the audio decoding means for performing decoding frame by frame divides an audio signal into plural subband signals and performs decoding for each of divided subbands.

36. The audio reproducing apparatus of claim 34 wherein the audio decoding means for performing decoding frame by frame decodes data coded by an MPEG1 audio layer 2 coding method.

37. The audio reproducing apparatus of claim 34 wherein the data expanding/compressing means includes correlation calculating means for calculating correlation between segments of a frame and a position at which the correlation is high, and sending shift amount by which waveform data of a segment is shifted to the position, the cross fading means shifts the waveform data of the segment according to the shift amount, and performs weighting addition to each segment data, and for a subsequent frame to be subjected to time-scale compression/expansion process, segment data is shifted and subjected to weighting addition, considering the shift amount of a frame which has been previously subjected to time-scale compression/expansion process.

38. The audio reproducing apparatus of claim 37 wherein the audio decoding means for performing decoding frame by frame divides an audio signal into plural subband signals and performs decoding for each of the divided subbands, the correlation calculating means calculates a correlation value for each subband, and weighting addition is performed by using the shift amount of a subband which has the largest correlation value.

39. The audio reproducing apparatus of claim 37 wherein the audio decoding means for performing decoding frame by frame divides an audio signal into plural subband signals and performs decoding for each of the divided subbands, and the correlation calculating means calculates a correlation value for a subband of the divided subbands which has the highest averaged value.

40. The audio reproducing apparatus of claim 34 wherein the data expanding/compressing means includes correlation calculating means for finding correlation between segments in each frame, the audio decoding means for performing decoding frame by frame divides an audio signal into plural subband signals and performs decoding for each of the divided subbands, and the correlation calculating means finds correlation between the segments by the use of data of a subband which contains pitch frequency of an audio signal.

41. An audio reproducing apparatus comprising:

audio decoding means for decoding an input audio signal frame by frame;

data expanding/compressing means for subjecting data in a decoded frame to time-scale modification process;

expansion/compression frequency control means for setting a frame cycle number and the number of frames to be expanded/compressed in the frame cycle, according to a given speed rate;

stationarity calculating means for calculating stationarities of audio signals in respective frames;

frame selecting means for selecting frames to be expanded/compressed according to an output of the stationarity calculating means and an output of the expansion/compression frequency control means; and data expansion/compression control means for instructing the data expanding/compressing means to subject the frame to one of time-scale compression process, time-scale expansion process, and process without time-scale modification process, the frame selecting means selecting high-stationarity frames with priority.

42. The audio reproducing apparatus of claim 41 wherein the audio decoding means for performing decoding frame by frame divides an audio signal into plural subband signals and performs decoding for each of divided subbands.

43. The audio reproducing apparatus of claim 41 wherein the audio decoding means for performing decoding frame by frame decodes data coded by an MPEG1 audio layer 2 coding method.

44. The audio reproducing apparatus of claim 41 wherein the audio decoding means for performing decoding frame by frame decodes data coded by an MPEG1 audio layer 2 coding method, and the stationarity calculating means estimates a stationarity of an audio signal based on scalefactor selection information indicating waveform statiorarity.

45. The audio reproducing apparatus of claim 41 wherein the data expanding/compressing means includes correlation calculating means for calculating correlation between segments of a frame and a position at which the correlation is high, and sending shift amount by which waveform data of a segment is shifted to the position, the cross fading means shifts the waveform data of the segment according to the shift amount, and performs weighting addition to each segment data, and for a subsequent frame to be subjected to time-scale compression/expansion process, segment data is shifted and subjected to weighting addition, considering the shift amount of a frame which has been previously subjected to time-scale compression/expansion process.

46. The audio reproducing apparatus of claim 45 wherein the audio decoding means for performing decoding frame by frame divides an audio signal into plural subband signals and performs decoding for each of the divided subbands, the correlation calculating means calculates a correlation value for each subband, and weighting addition is performed by using the shift amount of a subband which has the largest correlation value.

47. The audio reproducing apparatus of claim 45 wherein the audio decoding means for performing decoding frame by frame divides an audio signal into plural subband signals and performs decoding for each of the divided subbands, and the correlation calculating means calculates a correlation value for a subband of the divided subbands which has the highest averaged energy.

48. The audio reproducing apparatus of claim 41 wherein the data expanding/compressing means includes correlation calculating means for finding correlation between segments in each frame, the audio decoding means for performing decoding frame by frame divides an audio signal into plural subband signals and performs decoding for each of the divided subbands, and the correlation calculating means finds correlation between the segments by the use of data of a subband which contains pitch frequency of an audio signal.

49. An audio reproducing apparatus comprising:

audio decoding means for decoding an input audio signal frame by frame;

data expanding/compressing means for subjecting data in a decoded frame to time-scale modification process;

expansion/compression frequency control means for setting a frame cycle number and the number of frames to be expanded/compressed in the frame cycle, according to a given speed rate;

means for calculating degrees of energy change of audio signals in respective frames;

frame selecting means for selecting frames to be expanded/compressed according to an output of the means for calculating degrees of energy change and an output of the expansion/compression frequency control means; and data expansion/compression control means for instructing the data expanding/compressing means to subject the frame to one of time-scale compression process, time-scale expansion process, and process without time-scale modification process, the frame selecting means selecting frames with priority in which distortion is hardly detected because of masking effects, according to the degrees of energy change.

50. The audio reproducing apparatus of claim 49 wherein the audio decoding means for performing decoding frame by frame divides an audio signal into plural subband signals and performs decoding for each of divided subbands.

51. The audio reproducing apparatus of claim 49 wherein the audio decoding means for performing decoding frame by frame decodes data coded by an MPEG1 audio layer 2 coding method.

52. The audio reproducing apparatus of claim 49 wherein the audio decoding means for performing decoding frame by frame decodes data coded by an MPEG1 audio layer 2 coding method, and the means for calculating degrees of energy change estimates a degree of energy change of an audio signal based on a scalefactor index indicating a scalefactor at reproduction.

53. The audio reproducing apparatus of claim 49 wherein the data expanding/compressing means includes correlation calculating means for calculating correlation between segments of a frame and a position at which the correlation is high, and sending shift amount by which waveform data of a segment is shifted to the position, the cross fading means shifts the waveform data of the segment according to the shift amount, and performs weighting addition to each segment data, and for a subsequent frame to be subjected to time-scale compression/expansion process, segment data is shifted and subjected to weighting addition, considering the shift amount of a frame which has been previously subjected to time-scale compression/expansion process.

54. The audio reproducing apparatus of claim 53 wherein the audio decoding means for performing decoding frame by frame divides an audio signal into plural subband signals and performs decoding for each of the divided subbands, the correlation calculating means calculates a correlation value for each subband, and weighting addition is performed by using the shift amount of a subband which has the largest correlation value.

55. The audio reproducing apparatus of claim 53 wherein the audio decoding means for performing decoding frame by frame divides an audio signal into plural subband signals and performs decoding for each of the divided subbands, and the correlation calculating means calculates a correlation value for a subband of the divided subbands which has the highest averaged energy.

56. The audio reproducing apparatus of claim 49 wherein the data expanding/compressing means includes correlation calculating means for finding correlation between segments in each frame, the audio decoding means for performing decoding frame by frame divides an audio signal into plural subband signals and performs decoding for each of the divided subbands, and the correlation calculating means finds correlation between the segments by the use of data of a subband which contains pitch frequency of an audio signal.

57. An audio reproducing apparatus comprising:

audio decoding means for decoding an input audio signal frame by frame;

data expanding/compressing means for subjecting data in a decoded frame to time-scale modification process;

expansion/compression frequency control means for setting a frame cycle number and the number of frames to be expanded/compressed in the frame cycle, according to a given speed rate;

at least two of energy calculating means for calculating energies of audio signals in respective frames, means for calculating probabilities that respective frames contain humane voice, stationarity calculating means for calculating stationarities of audio signals in respective frames, and means for calculating degrees of energy change of audio signals in respective frames;

frame selecting means for selecting frames to be expanded/compressed according to outputs of plural calculating means and an output of the expansion/compression frequency control means; and data expansion/compression control means for instructing the data expanding/compressing means to subject the frame to one of time-scale compression process, time-scale expansion process, and process without time-scale modification process, the frame selecting means deciding frames to be selected according to the outputs of the plural calculating means.

58. The audio reproducing apparatus of claim 57 wherein the audio decoding means for performing decoding frame by frame decodes data coded by an MPEG1 audio layer 2 coding method, further comprising:

at least two of the energy calculating means, stationarity calculating means, and the means for calculating degrees of energy change wherein, the energy calculating means estimates an energy of an audio signal based on a scalefactor index indicating a scalefactor at reproduction, the stationarity calculating means estimates a stationarity of an audio signal based on scalefactor selection information indicating waveform stationarity, and the means for calculating degrees of energy change estimates a degree of energy change of an audio signal based on a scalefactor index indicating a scalefactor at reproduction.

* * * * *

UNITED STATES PATENT AND TRADEMARK OFFICE

CERTIFICATE OF CORRECTION

PATENT NO. : 6,484,137 B1
DATED : November 19, 2002
INVENTOR(S) : Hirotsugu Taniguchi et al.

It is certified that error appears in the above-identified patent and that said Letters Patent is hereby corrected as shown below:

Column 32,
Line 32, replace “claim 3” with -- claim 5 --.
Line 40, replace “claim 5” with -- claim 6 --.

Column 33,
Line 29, after “ claim 20” insert -- wherein --.

Column 36,
Line 59, replace “statiorarity” with -- stationarity --.

Signed and Sealed this

Twentieth Day of May, 2003

JAMES E. ROGAN
*Director of the United States Patent and Trademark Office*